US010816225B2

(12) United States Patent
Kim et al.

(10) Patent No.: US 10,816,225 B2
(45) Date of Patent: Oct. 27, 2020

(54) MOVABLE AIR CONDITIONER

(71) Applicant: LG Electronics Inc., Seoul (KR)

(72) Inventors: Moohee Kim, Seoul (KR); Dae Hyeok Kim, Seoul (KR); Moon Shin Kim, Seoul (KR); Joong Wook Kim, Seoul (KR); Jonghoon Park, Seoul (KR); Donghwal Lee, Seoul (KR); Daekwon Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 65 days.

(21) Appl. No.: 16/241,034

(22) Filed: Jan. 7, 2019

(65) Prior Publication Data

US 2019/0212018 A1 Jul. 11, 2019

(30) Foreign Application Priority Data

| | | |
|---|---|---|
| Jan. 8, 2018 | (KR) | 10-2018-0002522 |
| Mar. 20, 2018 | (KR) | 10-2018-0032277 |
| Apr. 13, 2018 | (KR) | 10-2018-0043581 |
| May 14, 2018 | (KR) | 10-2018-0054917 |
| Dec. 24, 2018 | (KR) | 10-2018-0168800 |

(51) Int. Cl.

| | |
|---|---|
| ***F24F 1/0007*** | (2019.01) |
| ***F24F 13/20*** | (2006.01) |
| ***F24F 1/022*** | (2019.01) |
| ***F24F 13/06*** | (2006.01) |

(Continued)

(52) U.S. Cl.

CPC ..... *F24F 1/00073* (2019.02); *F24F 1/022* (2013.01); *F24F 13/06* (2013.01); *F24F 13/20* (2013.01); *F24F 1/0018* (2013.01); *F24F 3/1603* (2013.01); *F24F 2013/202* (2013.01); *F24F 2013/207* (2013.01)

(58) Field of Classification Search

CPC ..... F24F 1/00073; F24F 13/20; F24F 1/022; F24F 13/06; F24F 2013/202; F24F 1/0018; F24F 1/02; F24F 1/04; F24F 3/1603; F24F 2013/207; F24F 13/222; F24F 13/22; F24F 1/029

See application file for complete search history.

(56) References Cited

U.S. PATENT DOCUMENTS

2008/0000251 A1* 1/2008 Lee ..... F24F 13/20 62/291

FOREIGN PATENT DOCUMENTS

| | | |
|---|---|---|
| JP | 10-205830 | 8/1998 |
| JP | 2014-102034 | 6/2014 |

(Continued)

OTHER PUBLICATIONS

Korean Office Action dated Apr. 1, 2020.

*Primary Examiner* — Emmanuel E Duke
(74) *Attorney, Agent, or Firm* — Finnegan, Henderson, Farabow, Garrett & Dunner LLP

(57) ABSTRACT

A movable air conditioner provides a structure in which a drain pan is disposed above an outdoor heat exchange part disposed in a lower accommodation space, an indoor heat exchange part is disposed in an upper accommodation space above the drain pan, and a control box is mounted on the drain pan. A portion of the heat sink of the control box is exposed to the upper accommodation space, and another portion of the heat sink is exposed to the lower accommodation space.

22 Claims, 20 Drawing Sheets

(51) Int. Cl.
*F24F 1/0018* (2019.01)
*F24F 3/16* (2006.01)

(56) References Cited

FOREIGN PATENT DOCUMENTS

| | | |
|---|---|---|
| KR | 10-2008-0003528 | 1/2008 |
| KR | 10-2016-0009232 | 1/2016 |

* cited by examiner

MOVABLE AIR CONDITIONER

CROSS-REFERENCE TO RELATED APPLICATION

This application claims the benefit of priority to Korean Patent Application No. 10-2018-0002522, filed on Jan. 8, 2018, Application No. 10-2018-0032277, filed on Mar. 20, 2018, Application No. 10-2018-0043581, filed on Apr. 13, 2018, Application No. 10-2018-0054917, filed on May 14, 2018 and Application No. 10-2018-0168800, filed on Dec. 24, 2018 the disclosures of which are incorporated herein by reference in their entireties.

FIELD OF THE INVENTION

The present disclosure relates to a movable air conditioner, and more particularly, to a movable air conditioner capable of effectively cooling a control box by using a flow of air suctioned into the movable air conditioner or a flow of cooled air.

DISCUSSION OF THE RELATED ART

In general, movable air conditioners have a configuration in which components such as a compressor, an evaporator (generally an indoor heat exchanger), an expansion valve, a condenser (generally, an outdoor heat exchanger), and the like are integrally included in a single product.

Movable air conditioners may be manufactured as a single product by arranging an evaporator and a condenser in a partitioned space to facilitate movement and installation of the movable air conditioner.

Movable air conditioners are manufactured by installing an evaporator and a condenser in a single case unlike general air conditioners in which an indoor unit and an outdoor unit are separately provided.

Movable air conditioners generally perform only a cooling function which cools indoor air but may allow a cooling cycle and a heating cycle to be switched by enabling a reverse circulation of a refrigerant.

Since movable air conditioners are easy to move and install, a user may easily place and install the movable air conditioner in a desired place without the help of a specialist who has acquired another technique for installation.

Movable air conditioners have a tendency to be miniaturized so that the movable air conditioner may be easily moved and installed. Components constituting the movable air conditioner may be efficiently arranged inside the movable air conditioner so that a large number of components may be installed inside the miniaturized product.

Further, a control box configured to control the movable air conditioner is installed inside the movable air conditioner. The control box includes heat generating devices such as an inverter. Cooling the heat generating devices efficiently is very important for achieving stable operation of the movable air conditioner FIGS. 1 and 2 illustrate a cooling structure of a heat generating device of a conventional movable air conditioner.

As illustrated in the drawings, a conventional movable air conditioner 100 includes a control part configured to control an inverter, and the control part includes a printed circuit board 210 on which devices are mounted. The printed circuit board 210 includes a heat generating device 212 which generates heat during operation. A heat sink 215 is attached to emit heat generated in the heat generating device 212.

Further, the conventional movable air conditioner has a structure in which the heat sink 215 is disposed inside a suction flow path 112 of an outdoor heat exchanger so that the heat sink 215 may be cooled by an air flow.

However, in such a structure, the heat sink 215 and the heat generating device 212 act as a resistance against the air flow, and also raise a temperature of the air flowing into the outdoor heat exchanger, thereby deteriorating the efficiency of the outdoor heat exchanger.

Further, since unfiltered external air is introduced and comes into contact with the printed circuit board 210 on which electronic devices are mounted, moisture or foreign substances (dust, pollen, and the like) may adhere to the printed circuit board 210, resulting in failure or malfunctioning.

SUMMARY OF THE INVENTION

The present disclosure is directed to providing an air conditioner capable of cooling a heat generating device of a control box provided in a movable air conditioner.

The present disclosure is also directed to providing a structure in which a heat sink is disposed on a heat generating device of a control box provided in a movable air conditioner and the heat sink may be cooled by an air flow generated in operation of the air conditioner.

The present disclosure is also directed to providing a movable air conditioner capable of improving the reliability of a product by cooling heat generated in a heat generating device using cooled air discharged from the movable air conditioner.

The present disclosure is also directed to providing an efficient component placement structure to miniaturize a movable air conditioner.

According to an aspect of the present disclosure, there is provided a movable air conditioner which provides a structure capable of effectively cooling a heat sink provided in a control box configured to control a refrigerant circuit part including an outdoor heat exchange part, an indoor heat exchange part, and a compressor.

According to another aspect of the present disclosure, there is provided a movable air conditioner which provides a structure in which a drain pan is disposed above an outdoor heat exchange part disposed in a lower accommodation space, an indoor heat exchange part is disposed above the drain pan in an upper accommodation space, and a control box is mounted on the drain pan, wherein a portion of the heat sink of the control box is exposed to the upper accommodation space, and another portion of the heat sink is exposed to the lower accommodation space.

According to still another aspect of the present disclosure, there is provided a movable air conditioner which includes: a casing configured to form an exterior of the movable air conditioner, a drain pan configured to partition an accommodation space provided in the casing into a lower accommodation space and an upper accommodation space, and a control box configured to control a refrigerant circuit part. The air conditioner includes a structure in which the control box is mounted on the drain pan so that a heat sink configured to cool a heat generating device of the control box is accommodated in the drain pan, and air in an upper region of the drain pan and air in a lower region of the drain pan communicate with each other with the heat sink interposed therebetween.

According to yet another aspect of the present disclosure, there is provided a movable air conditioner in which an outdoor heat exchanger is disposed above a drain pan and an indoor heat exchanger is disposed under the drain pan, and a control box is mounted on the drain pan. The movable air conditioner includes an auxiliary cooling flow path connected to a second blowing unit installed to be adjacent to the indoor heat exchanger and configured to guide air cooled while passing through the indoor heat exchanger to a heat sink.

Advantageous Effects

A movable air conditioner according to the present disclosure can effectively cool a heat sink disposed on a heat generating device by an air flow, thereby improving product performance and reliability A movable air conditioner according to the present disclosure can effectively cool a heat generating device without using a separate cooling fan or a cooling device by guiding a flow of air generated in operation of the air conditioner to a heat sink disposed on the heat generating device.

A movable air conditioner according to the present disclosure can cool a heat generating device disposed inside the movable air conditioner by using air cooled by the operation of the movable air conditioner. In addition, the movable air conditioner according to the present disclosure can efficiently utilize the cooled air by allowing the air which has cooled the heat generating device to be discharged into an indoor side.

Further, a movable air conditioner according to the present disclosure can efficiently downsize the overall size of the movable air conditioner by efficiently arranging components included therein.

In addition to the above-described effects, specific effects of the present disclosure will be described together with the following detailed description for implementing the present disclosure.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
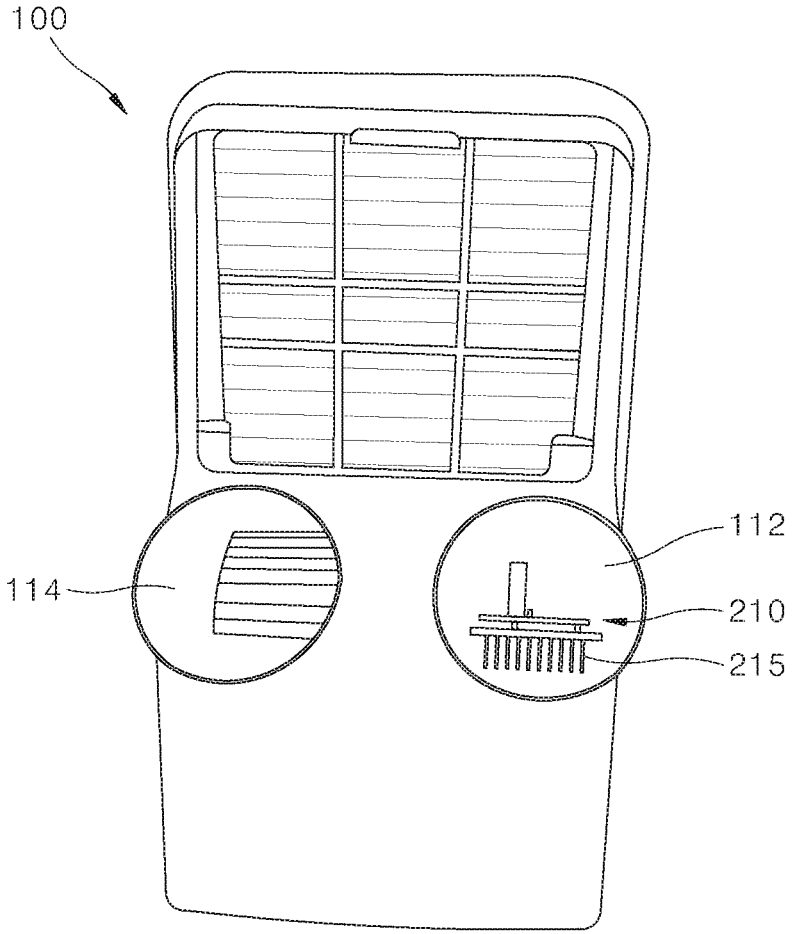
FIGS. 1 and 2 are views illustrating a cooling structure of a heat generating device of a conventional movable air conditioner.

The above-described objects, features, and advantages will be described below in detail with reference to the attached drawings to allow one of ordinary skill in the art to easily execute the technical concept of the present disclosure. In the description of the embodiments of the present disclosure, a certainly detailed explanation of a well-known function or component of the related art will be omitted when it is deemed to unnecessarily obscure the essence of the present disclosure. Hereinafter, exemplary embodiments of the present disclosure will be described in detail with reference to the attached drawings. Throughout the drawings, like reference numerals refer to like or similar components.

Hereinafter, arrangement of any configuration on an "upper portion (or lower portion" of a component or "on (or below)" the component may mean not only any configuration may be arranged to be in contact with the upper surface (or lower surface) of the component but also that another configuration may be interposed between the component and any configuration arranged on (or below) the component (optionally selected according to a technical field).

Further, it should be noted that when one component is described as being "connected," "coupled," or "joined" to another component, still another component may be "connected," "coupled," or "joined" between the two components, even though the component may be directly "connected," "coupled," or "joined" to the other component (optionally selected according to a technical field).

Figure 2:
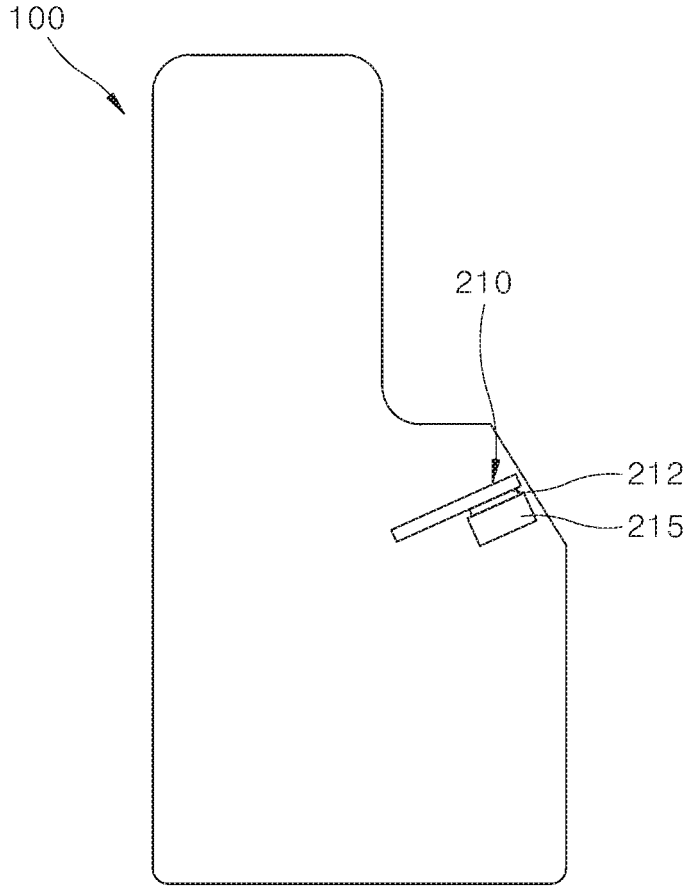
Figure 3:
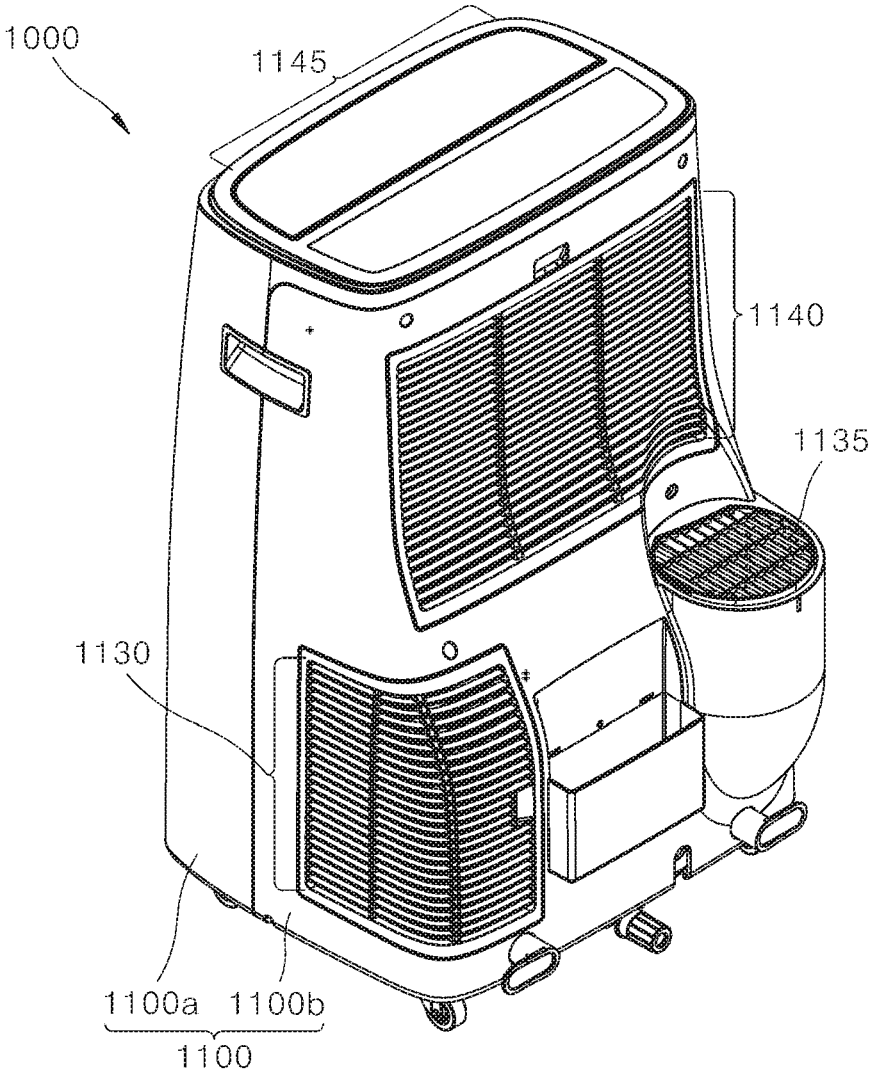
FIG. 3 is a perspective view of a movable air conditioner according to one embodiment of the present disclosure.
Figure 4:
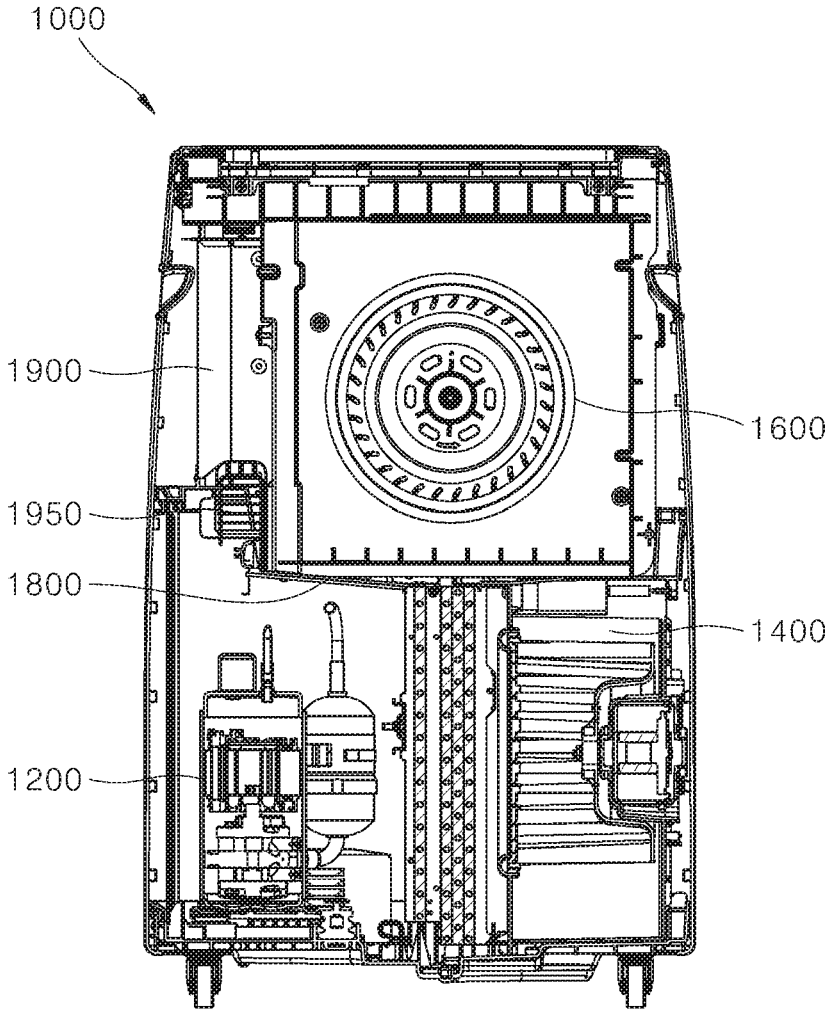
FIG. 4 is a longitudinal sectional view of the movable air conditioner shown in FIG. 3.
Figure 5:
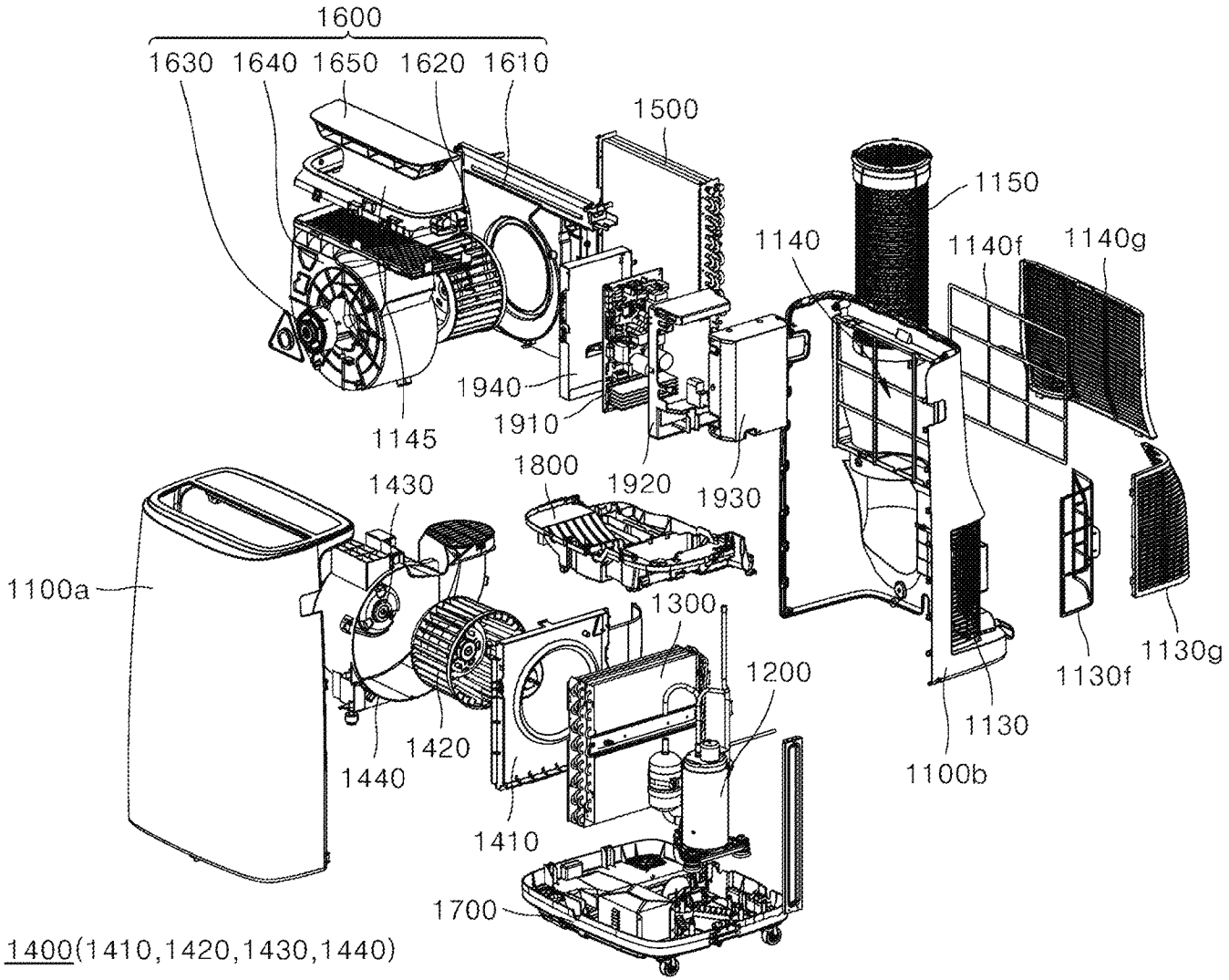
FIG. 5 is an exploded perspective view of the movable air conditioner shown in FIG. 3.

FIG. 3 is a perspective view of a movable air conditioner according to one embodiment of the present disclosure, FIG. 4 is a longitudinal sectional view of the movable air conditioner shown in FIG. 2, and FIG. 5 is an exploded perspective view of the movable air conditioner shown in FIG. 3.

Referring to FIGS. 3 to 5, a movable air conditioner 1000 according to the present disclosure includes a housing 1100 configured to form an exterior of the air conditioner, a compressor 1200, an outdoor heat exchanger 1300, a first blowing unit 1400, an indoor heat exchanger 1500, a second blowing unit 1600, a base plate 1700, a drain pan 1800, and a control box 1900.

The housing 1100 may be separated into a front housing 1100*a* forming a front side exterior and a rear housing 1100*b* forming a rear side exterior. The housing 1100 may be divided into a greater number of pieces or formed of a single housing forming exteriors of front and rear sides and lateral sides.

In describing the movable air conditioner 1000 according to the present disclosure, a side thereof in which the front housing 1100*a* is disposed is defined as a front side, and a side thereof in which the rear housing 1100*b* is disposed is defined as a rear side.

The base plate 1700 and the drain pan 1800 are disposed inside the housing 1100. The drain pan 1800 partitions an inner space of the housing 1100 into upper and lower portions. The base plate 1700 forms a bottom exterior of the movable air conditioner 1000.

The base plate 1700 is coupled to a lower portion of the housing 1100 and serves to support components installed inside the housings 1100*a* and 1100*b*.

The movable air conditioner 1000 is configured such that a refrigerant is circulated in the movable air conditioner 1000 and the refrigerant circulating inside the movable air conditioner 1000 may be heat-exchanged twice with the surrounding air.

The outdoor heat exchanger 1300 and the indoor heat exchanger 1500 are provided in an accommodation space inside movable air conditioner 1000 so that the refrigerant may be heat-exchanged with the surrounding air.

When the outdoor heat exchanger 1300 and the indoor heat exchanger 1500 are disposed in a single space which is not divided, the air heat-exchanged in the outdoor heat exchanger 1300 affects the heat exchange performed in the indoor heat exchanger 1500. In addition, the air heat-exchanged in the indoor heat exchanger 1500 affects the heat exchange performed in the outdoor heat exchanger 1300. As a result, overall heat exchange performance of the movable air conditioner 1000 may be deteriorated.

Therefore, the outdoor heat exchanger 1300 and the indoor heat exchanger 1500 are disposed in the space divided into the upper and lower portions. Further, the partitioning of the outdoor heat exchanger 1300 and the indoor heat exchanger 1500 into the upper and lower portions is performed by the drain pan 1800.

The accommodation space inside the movable air conditioner 1000 according to the present disclosure is partitioned into a first accommodation space on a lower side thereof and a second accommodation space on an upper side thereof by the drain pan 1800.

The indoor heat exchanger 1500 and the second blowing unit 1600 adjacent thereto are disposed in the second accommodation space. The indoor heat exchanger 1500 and the second blowing unit 1600 are coupled to an upper portion of the drain pan 1800. Thus, the drain pan 1800 serves to separate the second accommodation space from the first accommodation space and to fix the indoor heat exchanger 1500 and the second blowing unit 1600 disposed in the second accommodation space.

The outdoor heat exchanger 1300 and the first blowing unit 1400 adjacent thereto are disposed in the first accommodation space. The outdoor heat exchanger 1300 and the first blowing unit 1400 are coupled to the base plate 1700. The compressor 1200 is also coupled to the base plate 1700.

Further, upper end surfaces of the outdoor heat exchanger 1300 and the first blowing unit 1400 mounted on the base plate 1700 may be configured to support a bottom surface of the drain pan 1800. Such a structure may secure structural stability of the components such as the drain pan 1800, and the indoor heat exchanger 1500 and the second blowing unit 1600 which are coupled to the drain pan 1800.

The compressor 1200, the outdoor heat exchanger 1300, and the first blowing unit 1400 are mounted on the base plate 1700, and the indoor heat exchanger 1500, the second blowing unit 1600, and the control box 1900 are mounted on the drain pan 1800.

An outdoor heat exchange part is configured to discharge hot air generated in the outdoor heat exchanger 1300 to an outdoor space, and includes the base plate 1700, the compressor 1200, the outdoor heat exchanger 1300, and the first blowing unit 1400.

An indoor heat exchange part is configured to discharge cold air generated through the indoor heat exchanger 1500 to the outside of the housing, and includes the drain pan 1800, the indoor heat exchanger 1500, the second blowing unit 1600, and the control box 1900.

The housing 1100 includes an air suction port through which the outside air may be introduced into the rear housing, and a discharge port through which the air inside the housing may be discharged to the outside.

The air suction port includes a lower suction port 1130 and an upper suction port 1140. The discharge port includes an outdoor discharge port 1135 and an indoor discharge port 1145.

The air suctioned into the lower suction port 1130 is heat-exchanged through the outdoor heat exchanger 1300 and then discharged through the outdoor discharge port 1135. The outdoor discharge port 1135 is connected to a window through a discharge pipe 1150.

The air suctioned into the upper suction port 1140 is heat-exchanged through the indoor heat exchanger 1500 and then discharged to an indoor space through the indoor discharge port 1145.

The indoor discharge port 1145 is provided with a discharge door 1550 so that opening and closing of the indoor discharge port 1145 may be adjusted according to an operation state of the movable air conditioner. As illustrated in the drawings, since foreign substances such as dust may be introduced through the indoor discharge port 1145 when the indoor discharge port 1145 is disposed on an upper surface of the housing, the discharge door 1550 may be configured to close the indoor discharge port 1145 when the movable air conditioner is not used.

A lower suction port filter 1130*f* and a lower suction port grille 1130*g* are mounted on the lower suction port 1130. The lower suction port filter 1130*f* serves to remove foreign substances mixed with the air introduced into the first accommodation space of the movable air conditioner. The lower suction port grille 1130*g* serves to fix the lower suction port filter 1130*f*, to adjust the flow of the air flowing into the lower suction port 1130, and to improve the exterior quality of the movable air conditioner.

An upper suction port filter 1140*f* and an upper suction port grille 1140*g* are mounted on the upper suction port 1140. The upper suction port filter 1140*f* serves to remove foreign substances mixed with the air introduced into the second accommodation space of the movable air conditioner.

When the movable air conditioner according to the present disclosure performs a general cooling operation, the outdoor heat exchanger 1300 operates as a condenser, and the indoor heat exchanger 1500 operates as an evaporator.

The outdoor heat exchange part includes an outdoor heat exchanger 1300 and the first blowing unit 1400.

The first blowing unit 1400 includes an orifice 1410 configured to guide the air which has passed through the outdoor heat exchanger 1300 to be introduced into the first blowing unit 1400, a blowing fan 1420 configured to generate the air flow by rotation, a blowing motor 1430 configured to provide power for rotating the blowing fan 1420, and a flow path case 1440 configured to provide a path through which the air accelerated by the blowing fan 1420 is discharged.

The foreign substances are removed from the air suctioned through the lower suction port 1130 while the air is passing through the lower suction port filter 1130*f*, and then the air is heat-exchanged with the refrigerant in the outdoor heat exchanger 1300 and heated. Thereafter, the air is accelerated while passing through the first blowing unit 1400, and then is discharged through the outdoor discharge port 1135. The discharge pipe 1150 is connected to the outdoor discharge port 1135. The discharge pipe 1150 is connected to an installation kit (not shown) installed in the window. Thus, the heated air sent to the outdoor discharge port 1135 is discharged to the outdoor space through the discharge pipe 1150.

A refrigerant circuit part, which is configured to operate so that the refrigerant is heat-exchanged with the air while circulating, includes the outdoor heat exchange part, the indoor heat exchange part, and the compressor 1200.

The control box 1900 controls the refrigerant circuit part. The control box 1900 includes a printed circuit board 1910 on which various devices are mounted, a frame 1920 configured to surround a circumference of the printed circuit board 1910, a first casing 1930 configured to shield one surface of the printed circuit board 1910 coupled to the frame 1920, and a second casing 1940 configured to shield the other surface of the printed circuit board 1910 coupled to the frame 1920.

Detailed configuration of the control box 1900 will be described below with reference to FIGS. 6 and 7.

Figure 6:
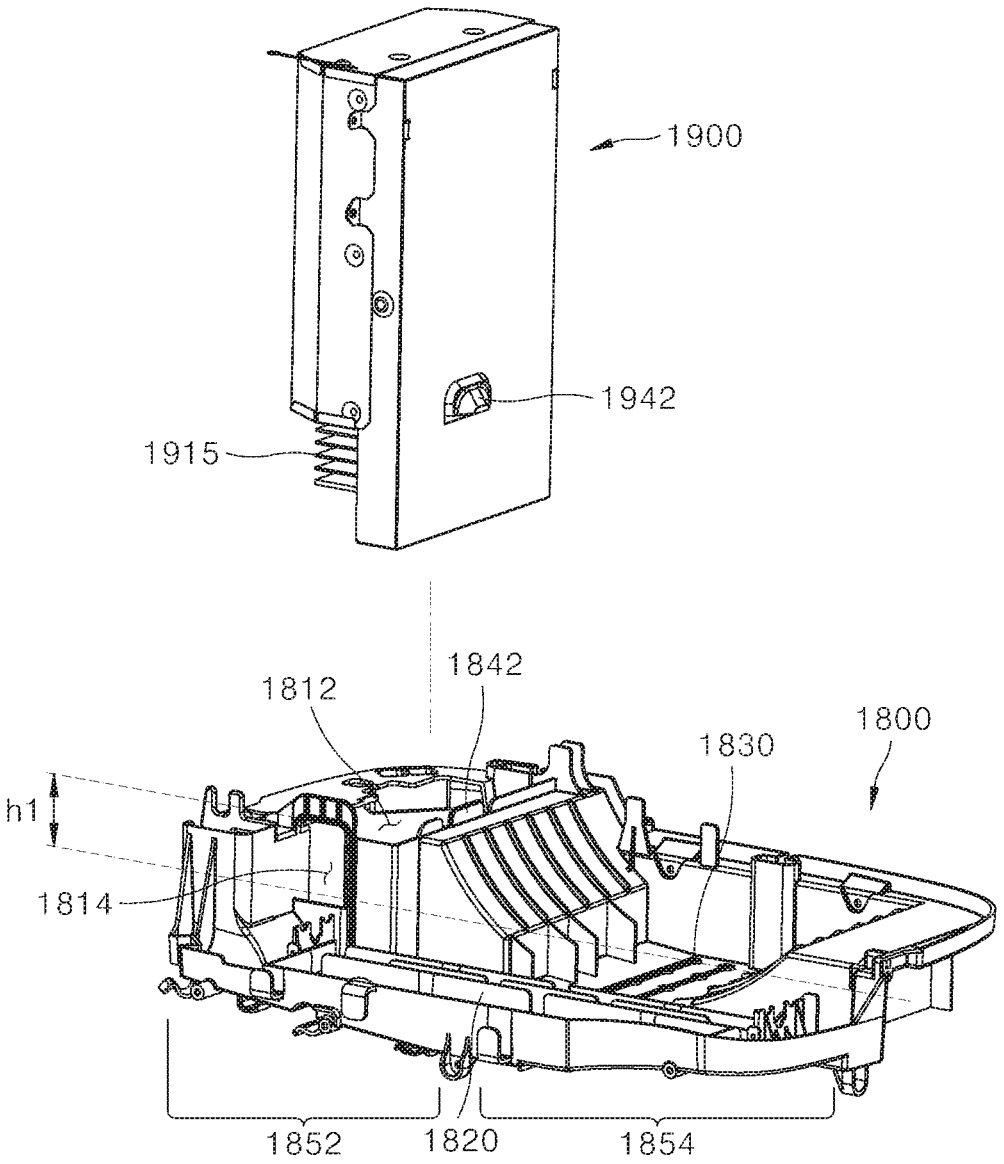
FIG. 6 is a separated perspective view illustrating a state in which a control box and a drain pan of the movable air conditioner according to embodiments of the present disclosure are separated.
Figure 7:
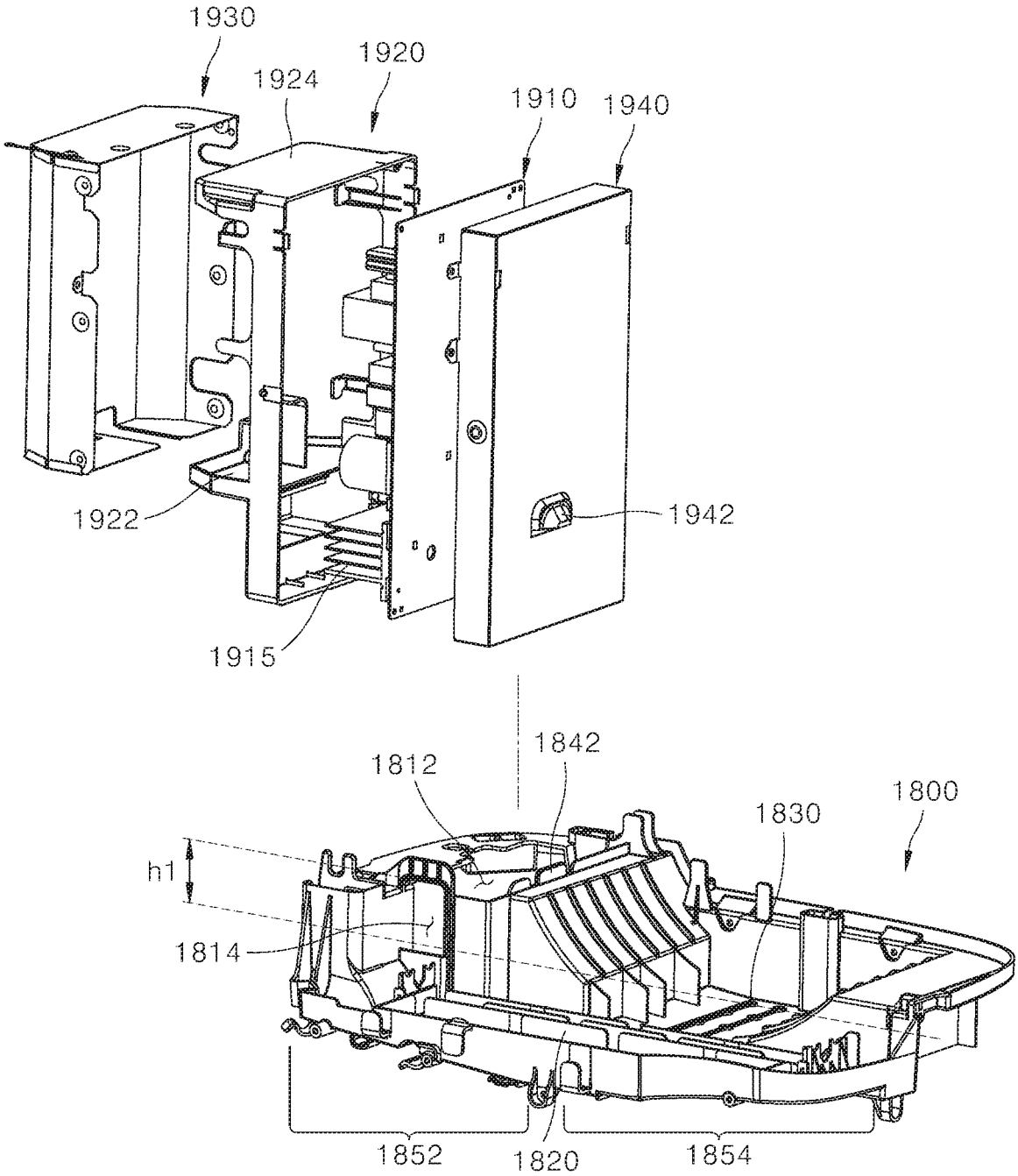
FIG. 7 is a separated perspective view illustrating a state in which the control box of FIG. 6 is further separated.

FIG. 6 is a separated perspective view illustrating a state in which a control box and a drain pan of the movable air conditioner according to embodiments of the present disclosure are separated, and FIG. 7 is a separated perspective view illustrating a state in which the control box of FIG. 6 is further separated.

As illustrated in the drawings, the control box 1900 is coupled to the drain pan 1800.

The control box 1900 includes the printed circuit board 1910 on which electronic devices are mounted. A heat generating device 1912 is disposed on one side of the printed circuit board. Further, a heat sink 1915 is disposed to come into contact with the heat generating device 1912 to emit heat generated in the heat generating device 1912.

The control box 1900 includes casings 1930 and 1940 configured to prevent foreign substances from being introduced into internal electronic components. The heat sink 1915 is disposed to be exposed to the outside of the casings 1930 and 1940. The heat generating device 1912 that generates heat during operation is included in the control box 1900, and when the heat generated in the heat generating device 1912 is not properly discharged, the inside of the control box 1900 may be overheated to cause malfunction or failure thereof The heat of the heat generating device 1912 is discharged to the outside through the heat sink 1915. The heat generating device 1912 includes power semiconductors or the like.

The control box 1900 includes the frame 1920 configured to surround an edge of the printed circuit board 1910, the first casing 1930 configured to seal one side surface of the frame 1920, and the second casing 1940 configured to seal the other side surface of the frame 1920.

Here, although the first casing seals one side surface of the frame, the heat sink 1915 may be exposed to the outside. As illustrated in the drawings, the heat sink 1915 is disposed on a lower portion of the printed circuit board 1910, and the first casing 1930 is configured to seal a section above the heat sink 1915 excluding the heat sink 1915.

The frame 1920 is coupled to surround the edge of the printed circuit board 1910. The frame 1920 includes a first rib 1922 and a second rib 1924 protruding toward the first casing 1930. The first rib 1922 may be formed in a portion directly above the heat sink 1915.

The first casing 1930 is coupled to seal a section between the first rib 1922 and the second rib 1924. In other words, a section under the first rib 1922 provided in the frame 1920 is not accommodated in the casings 1930 and 1940 but exposed to the outside. The heat generating device 1912 and the heat sink 1915 are disposed in the section under the first rib 1922.

Meanwhile, the first rib 1922 of the frame 1920 may be formed in a shape in which the first rib 1922 does not pass through a third opening 1812 formed on the drain pan 1800, which will be described below. In other words, the first rib 1922 of the frame 1920 may serve as a step so that the frame 1920 is placed over the drain pan 1800.

The second casing 1940 may include an insertion groove 1942 to which an insertion protrusion 1842 formed in the drain pan 1800 is coupled. When the insertion protrusion 1842 is fully coupled to the insertion groove 1942, the second casing 1940 may not descend any further. When the control box 1900 is coupled to the drain pan 1800 through the third opening 1812 of the drain pan 1800, the first casing 1930 is hooked by the step, and the insertion protrusion 1842 is inserted into and coupled to the insertion groove 1942 of the second casing 1940, so that the control box 1900 may be coupled to the drain pan 1800 so as to be fixed at a predetermined position of the drain pan 1800.

Meanwhile, the control box 1900 is coupled to the drain pan 1800 in such a manner that a lower portion of the control box 1900 on which the heat sink 1915 is disposed is accommodated in the drain pan 1800, and thus, a coupling height needs to be ensured to secure coupling stability between the control box 1900 and the drain pan 1800.

In other words, a vertical height (thickness) of the section of the drain pan 1800, to which the control box 1900 is coupled, may be greater than other portions.

Referring to FIG. 6, it may be seen that a left portion of the drain pan 1800 is formed to be thicker than a right portion of the drain pan 1800 by hl. The drain pan 1800 serves to partition the space, to support the indoor heat exchange part mounted on the drain pan 1800, and to guide condensed water generated in the indoor heat exchange part.

The left portion of the drain pan 1800 may be referred to as a first base 1852, and the right portion of the drain pan 1800 may be referred to as a second base 1854. The first base 1852 is a portion where the control box 1900 is mounted and is formed to be thicker than the second base 1854.

In the case of the illustrated embodiment, the first base 1852 and the second base 1854 may be configured to have different thicknesses by forming the bottom surfaces thereof to have the same height and making the height difference by hl from the upper surfaces thereof, or by forming the upper surfaces thereof to have the same height and making a difference in heights of the bottom surfaces thereof.

The thickness of the drain pan 1800 necessary for performing the function of partitioning the space, necessary for the role of supporting the indoor heat exchange part, and necessary for the role of guiding the condensed water is about the same as that of the second base 1854. However, when the entire drain pan 1800 is formed with the thickness of about the second base 1854, the height of the section of the drain pan 1800, to which the control box 1900 is coupled, is too low, so that the control box 1900 may be incompletely fixed.

In consideration of this point, the drain pan 1800 of the movable air conditioner according to the present disclosure may be formed such that the thickness of the first base 1852, which is the portion on which the control box 1900 is mounted, is thicker than the other portion (the second base 1854).

A plurality of bottom partition ribs 1820 may be formed in the drain pan 1800.

Here, the bottom partition ribs 1820 are configured to form a plurality of compartments on an upper surface of the drain pan 1800 and to form a space through which the condensed water may flow. The plurality of bottom partition ribs 1820 may be formed at regular intervals and formed to protrude upward from the upper surface of the drain pan 1800.

Accordingly, a certain space is formed in the drain pan 1800 so that the condensed water generated in the indoor heat exchanger 1500 may flow in the upper surface of the drain pan 1800.

Further, a plurality of bottom condensate holes 1830 are formed in the drain pan 1800. Here, the bottom condensate holes 1830 are configured to move the condensed water falling from the indoor heat exchanger 1500 to a lower portion of the drain pan 1800.

Meanwhile, a condensate drop guide serves to guide the condensed water, which is moved to the bottom surface of the drain pan 1800, to be directly dropped without flowing to other portions.

Accordingly, the condensate drop guide is formed to protrude downward from the bottom surface of the drain pan 1800. More specifically, the condensate drop guide is formed to extend downward from each bottom condensate hole 1830. The condensate drop guide may be formed to extend downward from the bottom condensate hole 1830 and have a cylindrical shape corresponding to the bottom condensate hole 1830.

Meanwhile, the drain pan 1800 may be provided with a plurality of regions formed so that components installed in the second accommodation space may be installed while avoiding interference.

Figure 8:
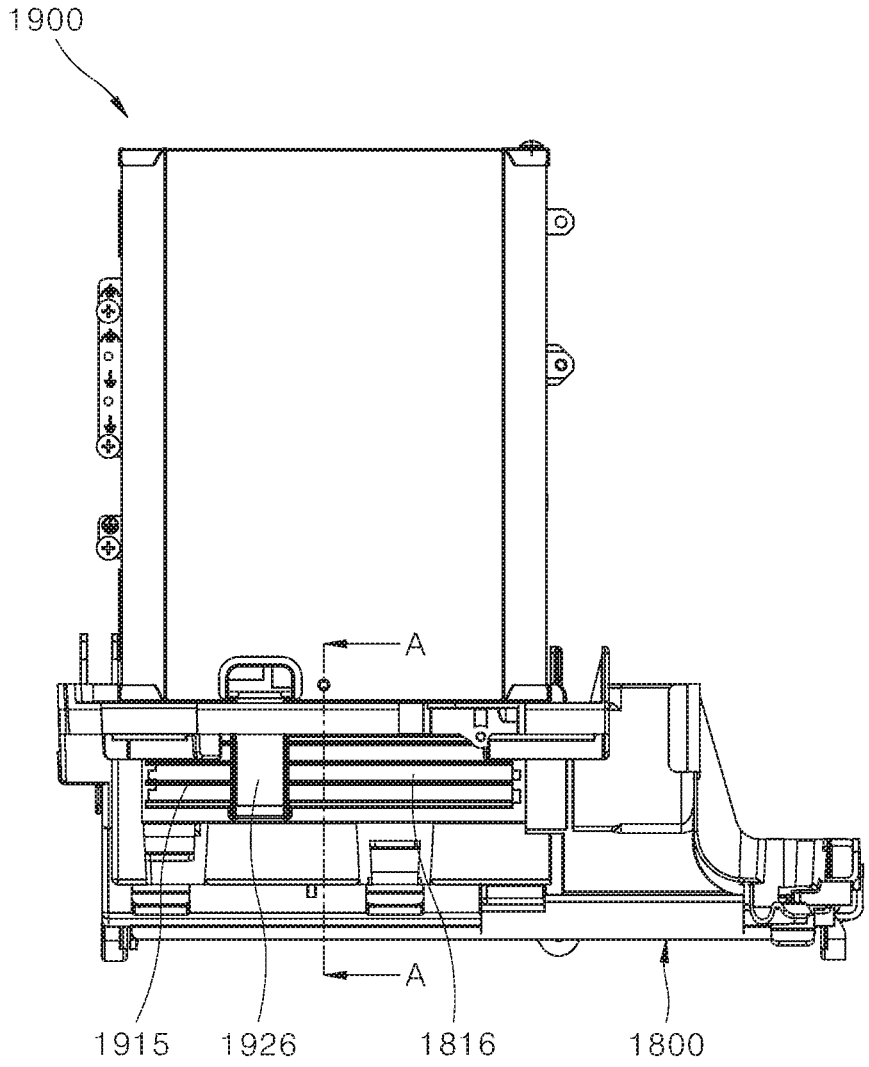
FIG. 8 is a side view illustrating a coupling state of the control box and the drain pan of the movable air conditioner according to the present disclosure.
Figure 9:
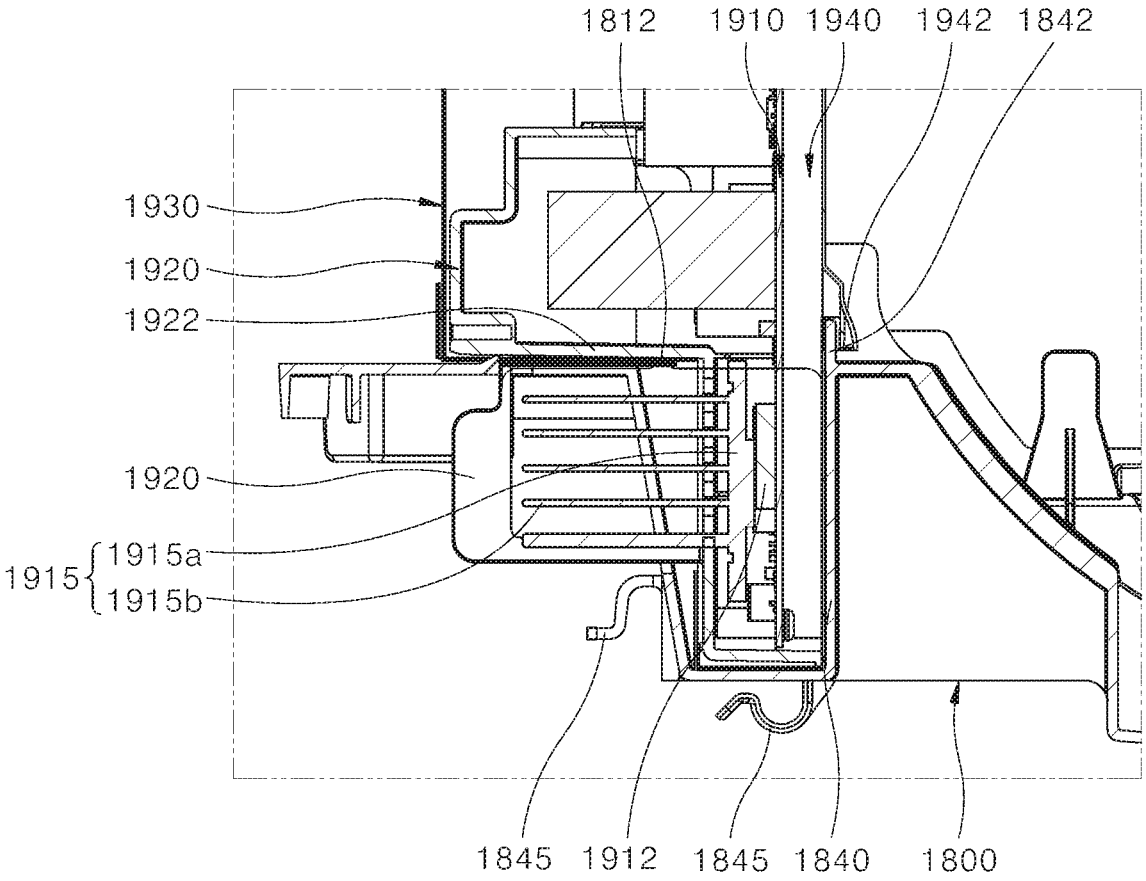
FIG. 9 is a cross-sectional view taken along line A-A in FIG. 8.
Figure 10:
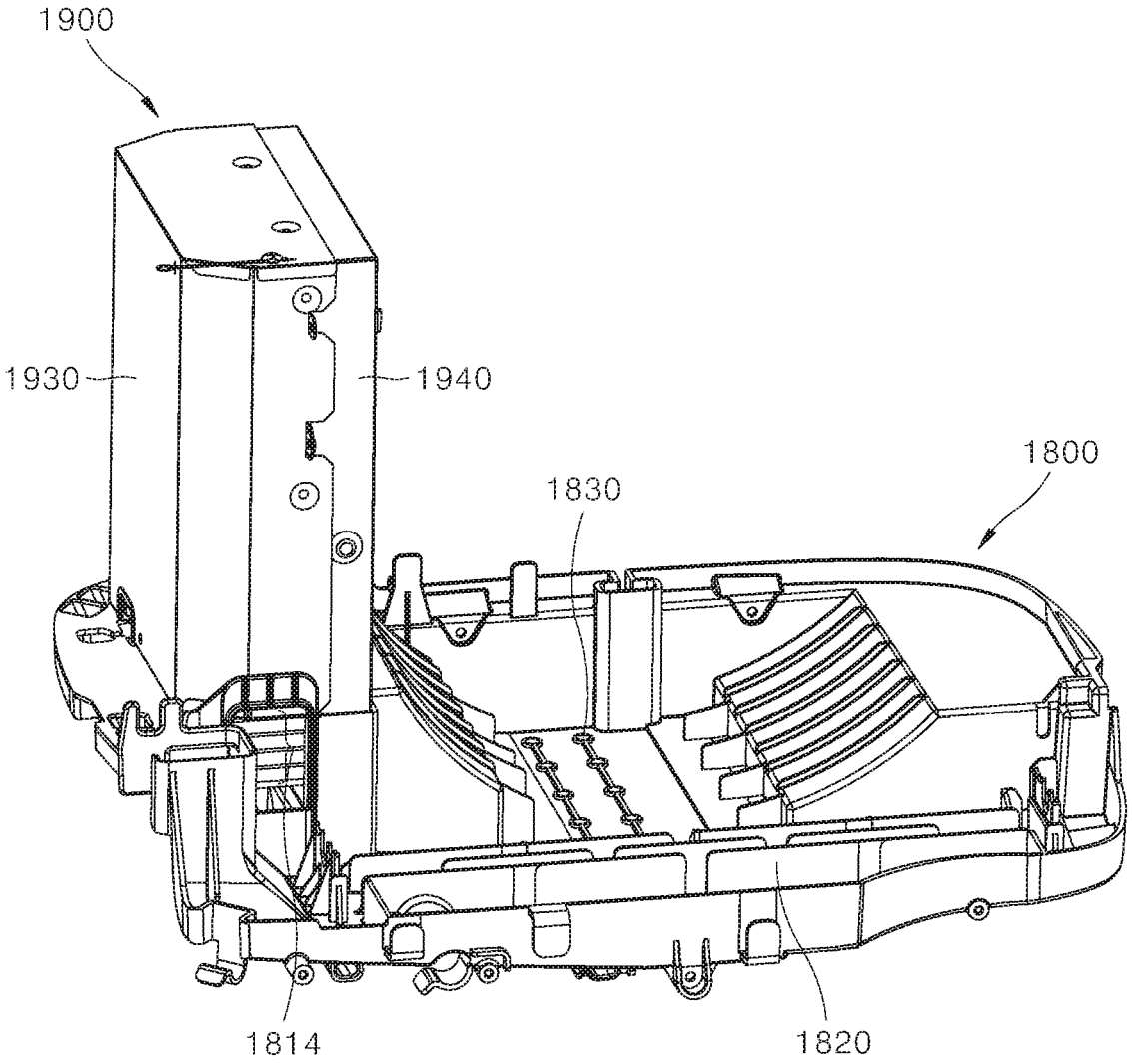
FIGS. 10 and 11 are perspective views illustrating the coupling state of the control box and the drain pan of the movable air conditioner according to the present disclosure.
Figure 11:
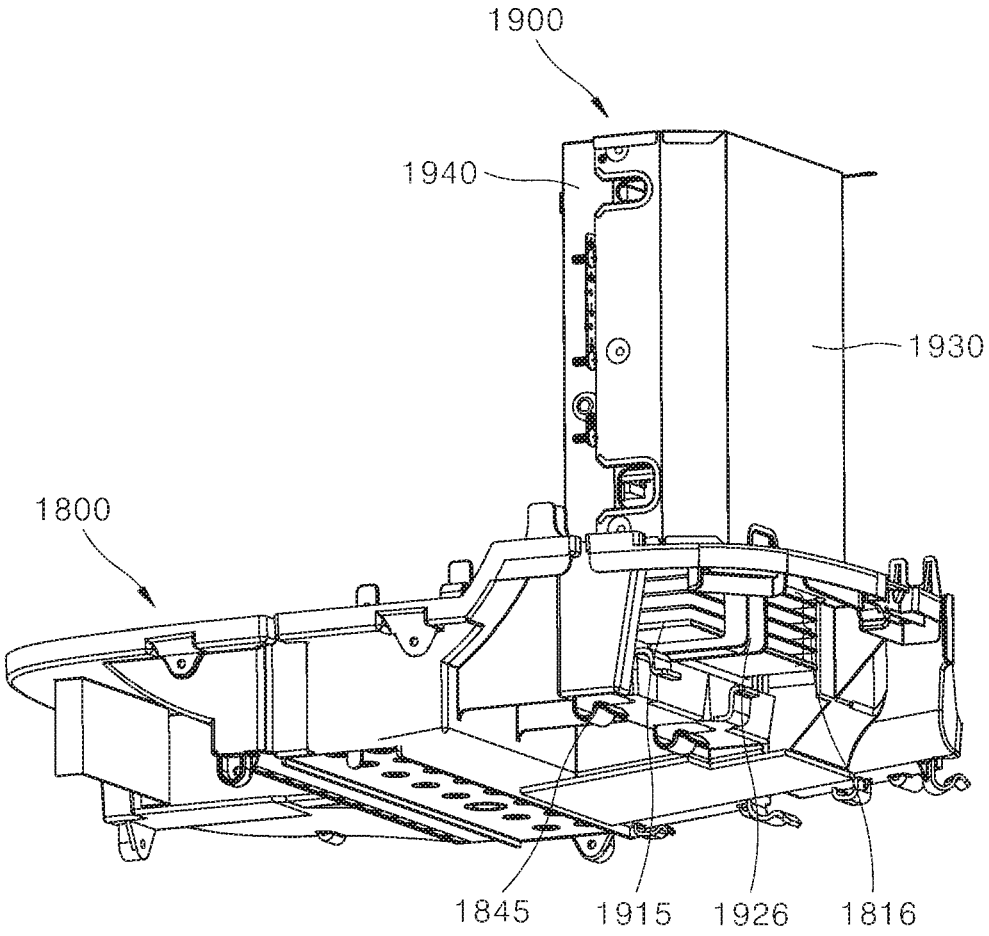

FIG. 8 is a side view illustrating a coupling state of the control box and the drain pan of the movable air conditioner according to the present disclosure, FIG. 9 is a cross-sectional view taken along line A-A in FIG. 8, and FIGS. 10 and 11 are perspective views illustrating the coupling state of the control box and the drain pan of the movable air conditioner according to the present disclosure.

Referring to FIGS. 8 to 11, when the control box 1900 is coupled to the drain pan 1800, the heat sink 1915, which is exposed at the lower portion of the control box 1900, is exposed to a first region in which the outdoor heat exchanger is disposed, with the heat sink 1915 extending through the drain pan 1800. Here, a region configured to expose the heat sink 1915 to the first region is a second opening 1816.

The third opening 1812 described above is a portion into which the heat sink 1915 is inserted, a first opening 1814 is a portion for allowing the air from the upper suction port 1140 to be introduced to the heat sink 1915, and the second opening 1816 is a portion for allowing the air passing through the heat sink 1915 to be introduced into the first region.

Meanwhile, the third opening 1812 and the first opening 1814 may be formed to be separated from each other but may be formed to be connected to each other. Further, the second opening 1816 and the first opening 1814 may be formed to be separated from each other but may be formed to be connected to each other. The third opening 1812, the first opening 1814, and the second opening 1816 may perform functionally distinguished roles but may be physically connected to each other.

The heat sink 1915 includes a conductive plate 1915*a* coming into contact with the heat generating device 1912 and a plurality of radiation fins 1915*b* connected to the conductive plate 1915*a*. The conductive plate 1915*a* is directly attached to the heat generating device 1912 or fixed to maintain a state of being in close contact with the heat generating device 1912 to receive the heat of the heat generating device 1912 through conduction. Here, thermal grease may be applied between the conductive plate 1915*a* and the heat generating device 1912.

The radiation fins 1915*b* of the heat sink 1915 are formed to be exposed to the outside of the casings 1930 and 1940 of the control box 1900 to be in contact with the air, thereby emitting the heat. The heat sink 1915 may be made of a copper or aluminum material, or the like, which is excellent in heat transfer efficiency.

A plurality of radiation fins 1915*b* may be arranged in parallel to enlarge a contact area with the air. Here, the radiation fins 1915*b* may be disposed such that an arrangement direction thereof is made parallel to a flow direction of the air flowing around the radiation fins 1915*b*. In the case of the illustrated embodiment, the radiation fins 1915*b* are disposed to be arranged in parallel in a horizontal direction to minimize resistance against the air flow in the horizontal direction.

Even when the heat sink 1915 exposed in the control box 1900 is mounted on the drain pan 1800, the radiation fins 1915*b* of the heat sink 1915 may be exposed to the outside.

Accordingly, the drain pan 1800 includes the second opening 1816 configured to expose the radiation fins 1915*b* of the heat sink to the first region. The second opening 1816 serves to allow the air, which has cooled the heat sink 1915, to be introduced into the second accommodation space and be discharged to the outdoor space.

A guide surface 1840 configured to guide a mounting position of the control box 1900 is provided around a heat sink accommodation hole 1810. The guide surface 1840 is formed to support at least two surfaces of the control box 1900.

The guide surface 1840 serves to guide the control box 1900 to be coupled to the drain pan 1800 in a predetermined position.

Meanwhile, the drain pan 1800 may be provided with a holder 1845 configured to fix wiring, piping, and the like. The holder 1845 serves as a fixture configured to fix the wiring or the refrigerant circulation piping connected to the control box 1900.

Referring to FIG. 9, it may be confirmed that the first rib 1922 provided in the frame 1920 of the control box 1900 does not pass through the third opening 1812 formed in the drain pan 1800 but placed over the third opening 1812. Further, the insertion protrusion 1842 of the drain pan 1800 is inserted into the insertion groove 1942 provided in the second casing 1940 such that both sides of the control box 1900 are coupled to the drain pan 1800 while maintaining a predetermined position with respect to the drain pan 1800.

Referring to the drawings, the printed circuit board 1910 has a shape to be accommodated in the first casing 1930 and the second casing 1940. The first casing 1930 and the second casing 1940 may be made of a metal material. When the first casing and the second casing 1940 are made of a metal material, electromagnetic waves emitted from the printed circuit board 1910 may be blocked.

Meanwhile, the frame of the control box 1900 may include a cable guide 1926 traversing the second opening 1816. The cable guide 1926 may be formed in an L shape and in a shape to surround a side surface and a bottom surface of the heat sink 1915. The cable guide 1926 serves to check whether the control box 1900 is correctly coupled, to prevent the control box 1900 from being excessively inserted, and to guide a route of the wiring connected to the control box. The cable guide 1926 may be formed in the shape of a C-shaped cross-section to accommodate the wiring therein.

When the control box 1900 is coupled to the drain pan 1800, the heat sink 1915 is exposed to the first accommodation space through the first opening 1814 of the drain pan 1800 as shown in FIG. 10 and exposed to the second accommodation space through the second opening 1816 of the drain pan 1800 as shown in FIG. 11.

The air which has cooled the heat sink 1915 is introduced into the first opening to cool the heat sink 1915, and then introduced into the second accommodation space through the second opening 1816 to be discharged to the outdoor space from the second accommodation space.

Figure 12:
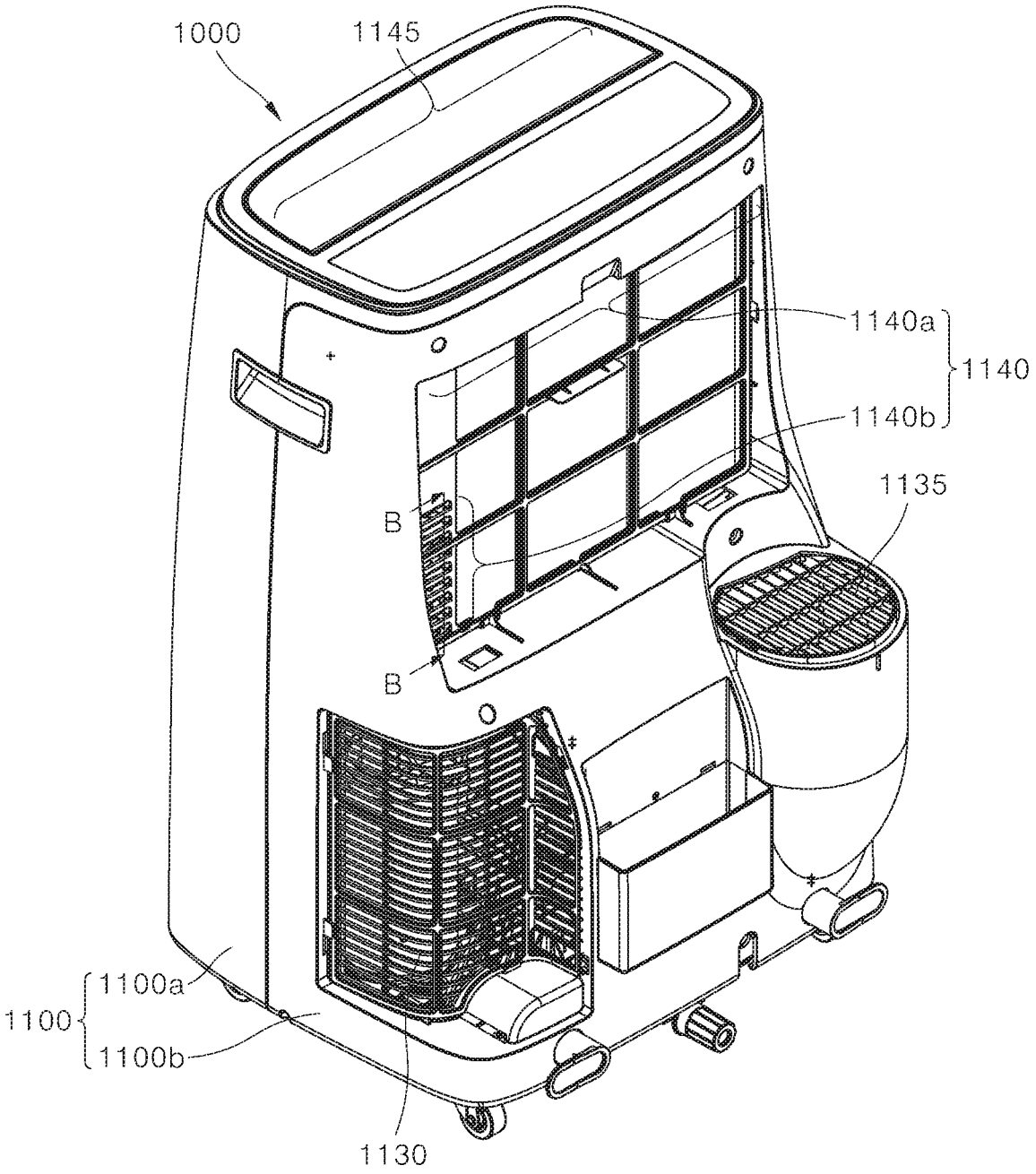
FIG. 12 is a perspective view illustrating a state of the movable air conditioner shown in FIG. 1, in which a suction port grille is removed.
Figure 13:
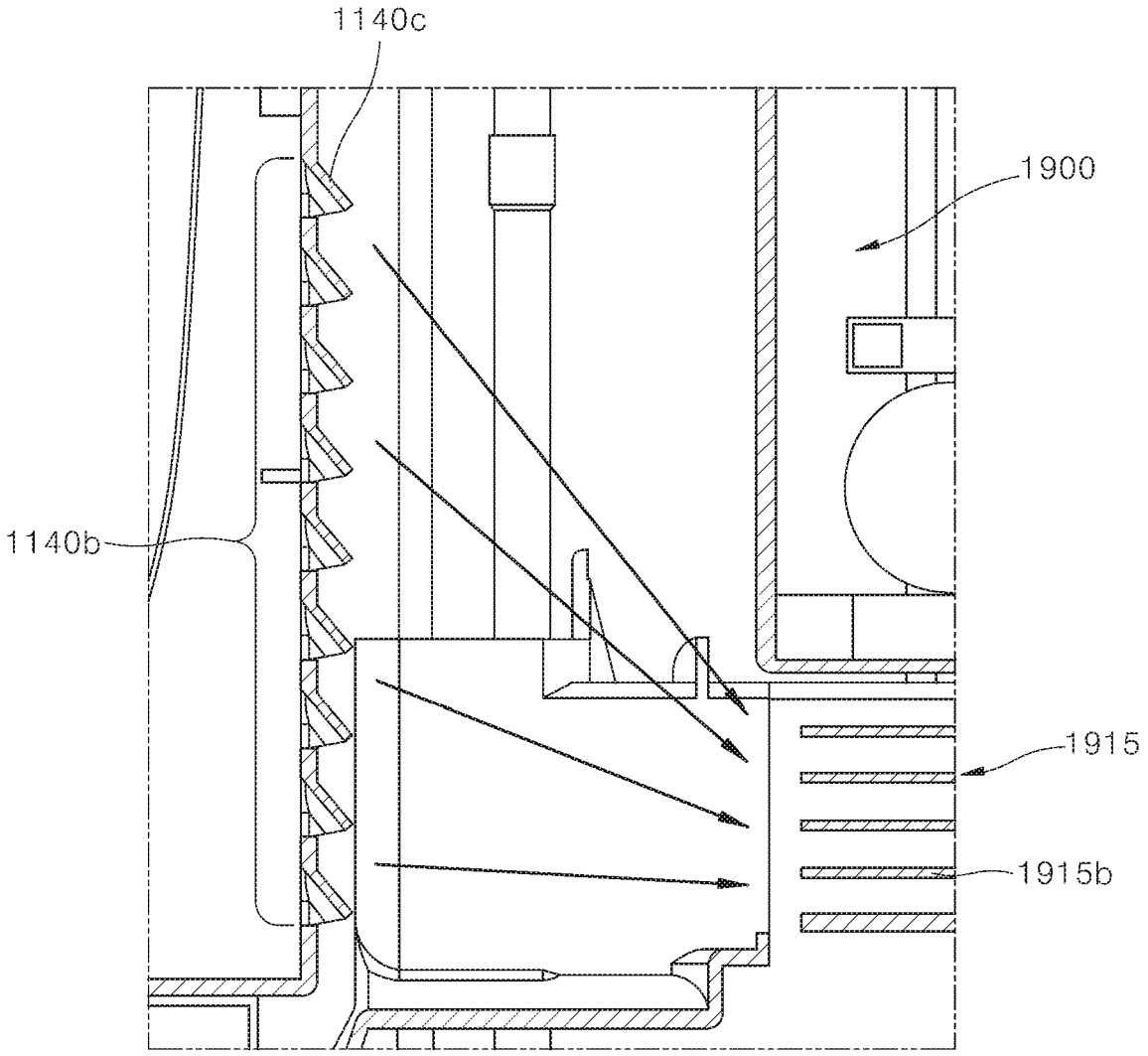
FIG. 13 is a schematic cross-sectional view taken along line B-B in FIG. 12 which illustrates the movable air conditioner.

FIG. 12 is a perspective view illustrating a state of the movable air conditioner shown in FIG. 1, in which a suction port grille is removed, and FIG. 13 is a schematic cross-sectional view taken along line B-B in FIG. 12 which illustrates the movable air conditioner.

As illustrated in the drawings, the upper suction port 1140 of the movable air conditioner 1000 is a portion through which the air is introduced into the second accommodation space. The upper suction port 1140 includes a main suction port 1140*a*, which is a region through which the air is introduced into the indoor heat exchanger 1500, and an auxiliary suction port 1140*b* which is a region through which the air for cooling the heat sink 1915 is introduced.

The auxiliary suction port 1140*b* may be provided with a vane 1140*c* configured to guide the air suctioned into the auxiliary suction port 1140*b* toward the heat sink 1915. As shown in FIG. 13, when the vertical height of the auxiliary suction port 1140*b* is configured to be greater than the vertical height of the heat sink 1915, the flow rate of the air flowing into the auxiliary suction port 1140*b* may be secured, and the flow of the introduced air may be smoothly performed by providing the downwardly inclined vane 1140*c* on an inner surface of the auxiliary suction port 1140*b*.

The auxiliary suction port 1140*b* which is the region through which the air for cooling the heat sink 1915 is suctioned is arranged close to the main suction port 1140*a* which is the region through which the air is suctioned into the indoor heat exchanger 1500, so that the auxiliary suction port 1140*b* and the main suction port 1140*a* form the single upper suction port 1140. Such a structure may make the exterior more attractive by allowing the upper suction port filter 1140*f* and the upper suction port grille 1140*g*, which cover the entire upper suction port 1140, to be coupled to each other. Also, the air for cooling the heat sink 1915 does not affect the air flowing into the indoor heat exchanger 1500.

Further, since the air introduced into the heat sink 1915 also passes through the filter, foreign substances may be prevented from being suctioned into the movable air conditioner.

The filter serves to filter out the foreign substances such as dust mixed with the air introduced into the air conditioner. When the filter is not provided at the suction port, dust or foreign substances may be accumulated inside the movable air conditioner, which may cause a failure such as an earth leakage or a short circuit.

Due to the configuration as described above, the air introduced from the outside through the auxiliary suction port 1140*b* flows toward the heat sink 1915 as illustrated by arrows in FIG. 13, and thus the heat sink 1915 may be cooled more efficiently.

Figure 14:
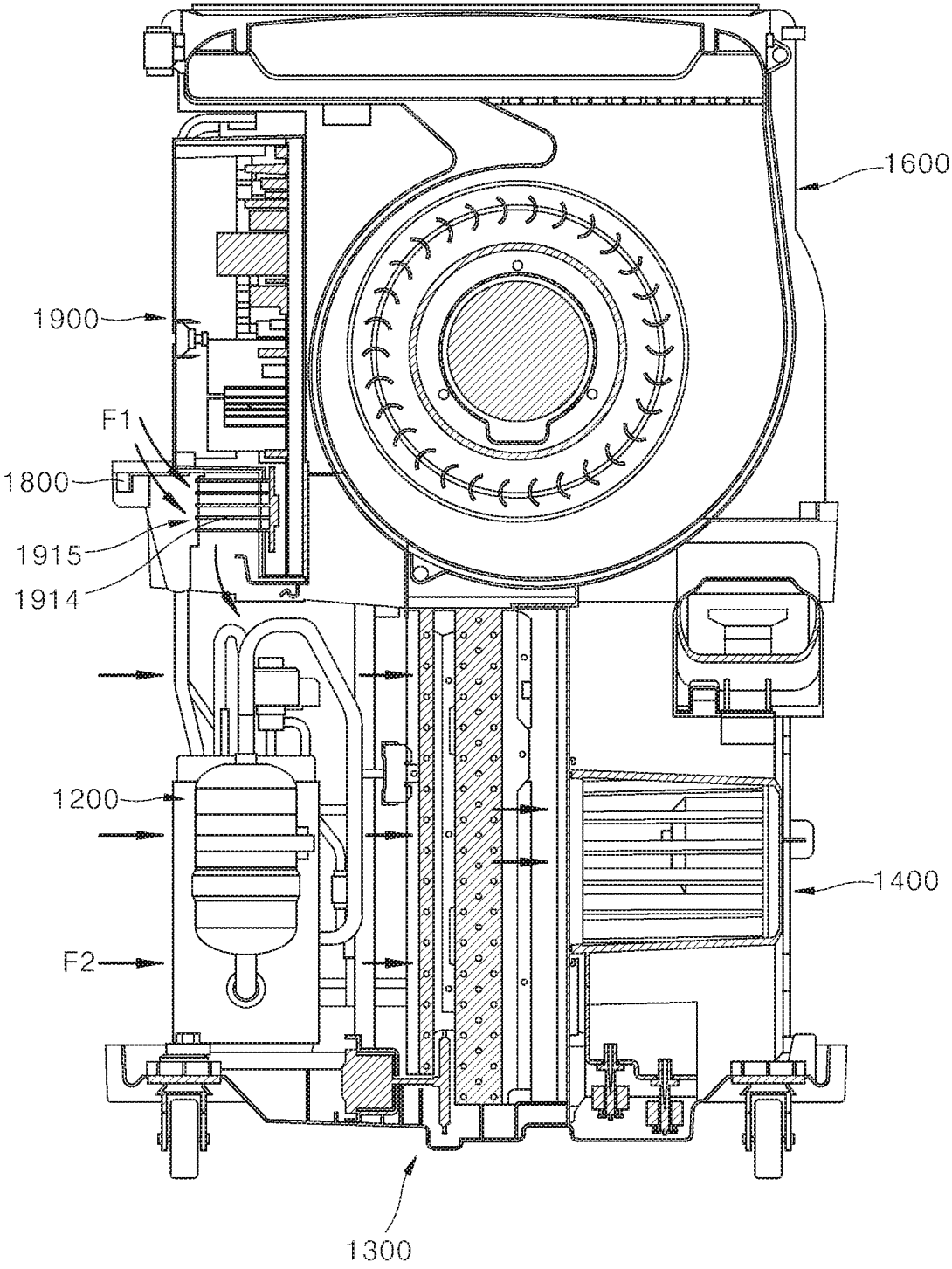
FIG. 14 is a use state view schematically illustrating an air flow of an outdoor heat exchange part in the movable air conditioner according to one embodiment of the present disclosure.
Figure 15:
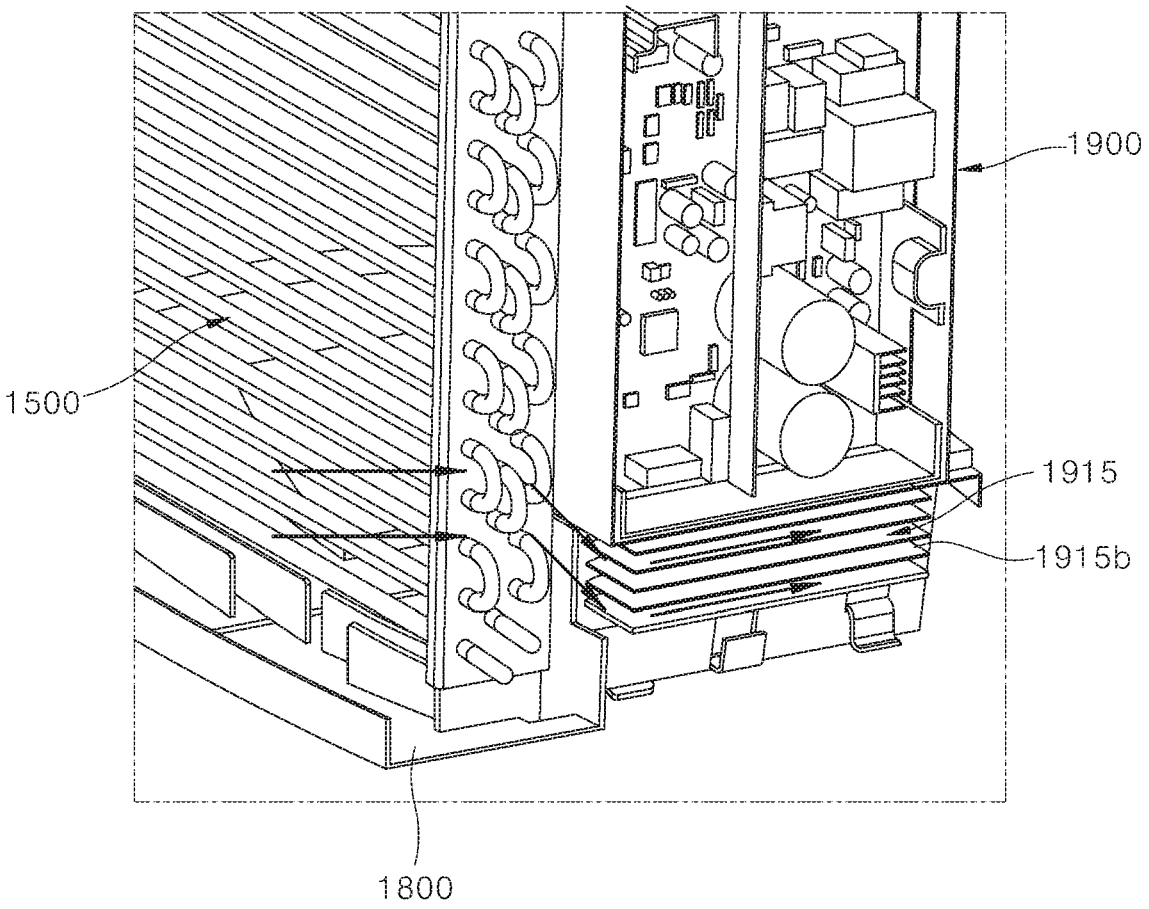
FIG. 15 is a use state view schematically illustrating an air flow that flows into a heat sink in the movable air conditioner shown in FIG. 14.

FIG. 14 is a use state view schematically illustrating an air flow of an outdoor heat exchange part in an air conditioner according to one embodiment of the present disclosure, and FIG. 15 is a use state view schematically illustrating an air flow that flows into a heat sink in the air conditioner shown in FIG. 14.

As illustrated in the drawings, an outside air F1 introduced through the auxiliary suction port 1140*b* cools the radiation fins 1915*b* of the heat sink 1915 while passing through the heat sink 1915.

In addition, the outside air F1 flows into the lower portion of the drain pan 1800, is merged with an outside air F2 flowing through the main suction port, and is supplied with a flowing force by the first blowing unit 1400, and is discharged to the outside through a connecting duct of a piping part.

Due to the configuration as described above, a design structure of the flow path without including a separate additional cooling configuration may allow the outside air to flow toward the radiation fins 1915*b* of the heat sink 1915 and to cool the heat sink 1915, and may allow the heat generated in the heat generating device 1912 to which the heat sink 1915 is attached to be discharged.

Hereinafter, a cooling structure of a control box according to another embodiment of the present disclosure will be described. Following embodiments provide a structure configured to cool a heat sink of the control box using cooled air inside a movable air conditioner.

Figure 16:
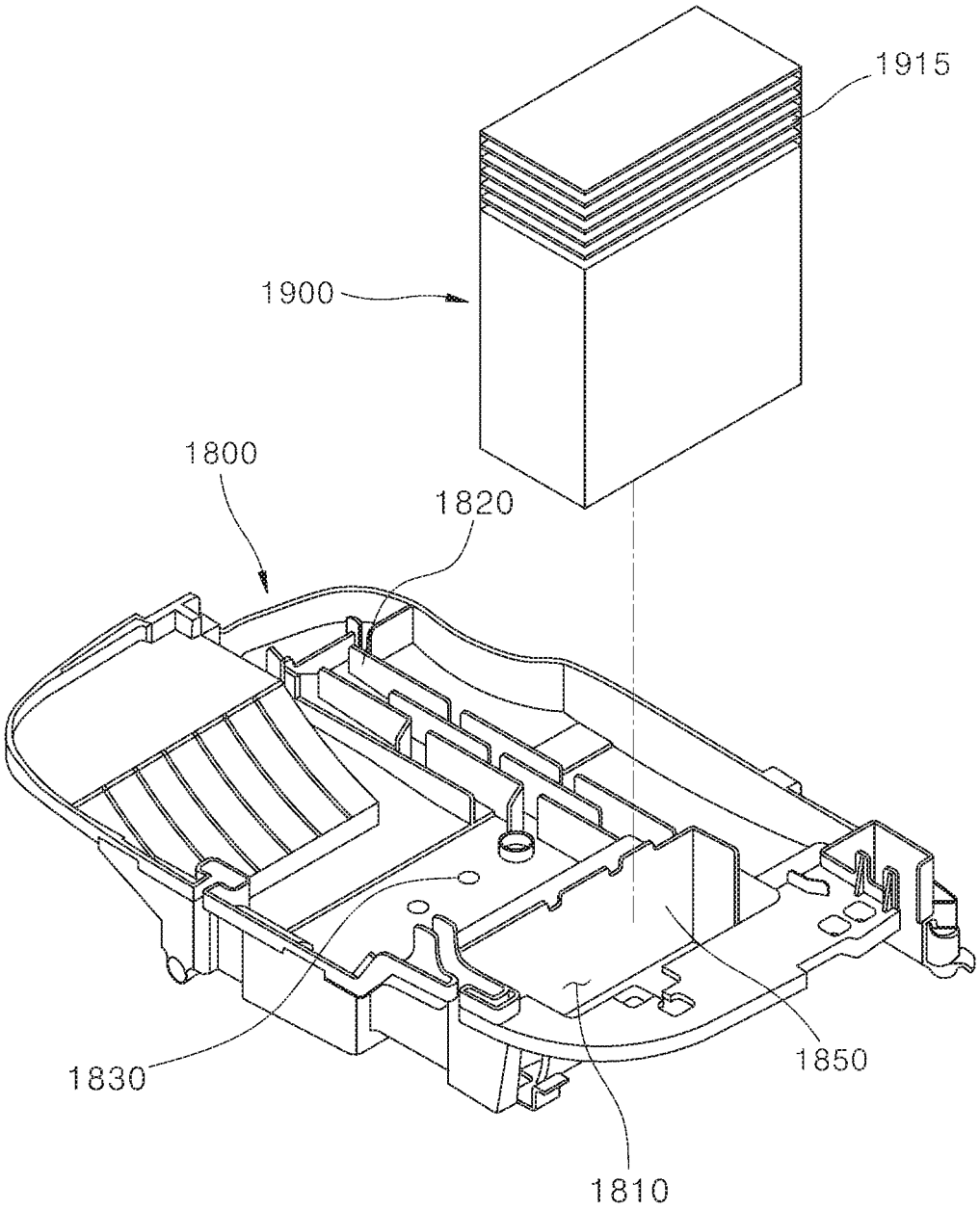
FIG. 16 is a view illustrating a coupling structure of a control box and a drain pan according to another embodiment of the present disclosure.
Figure 17:
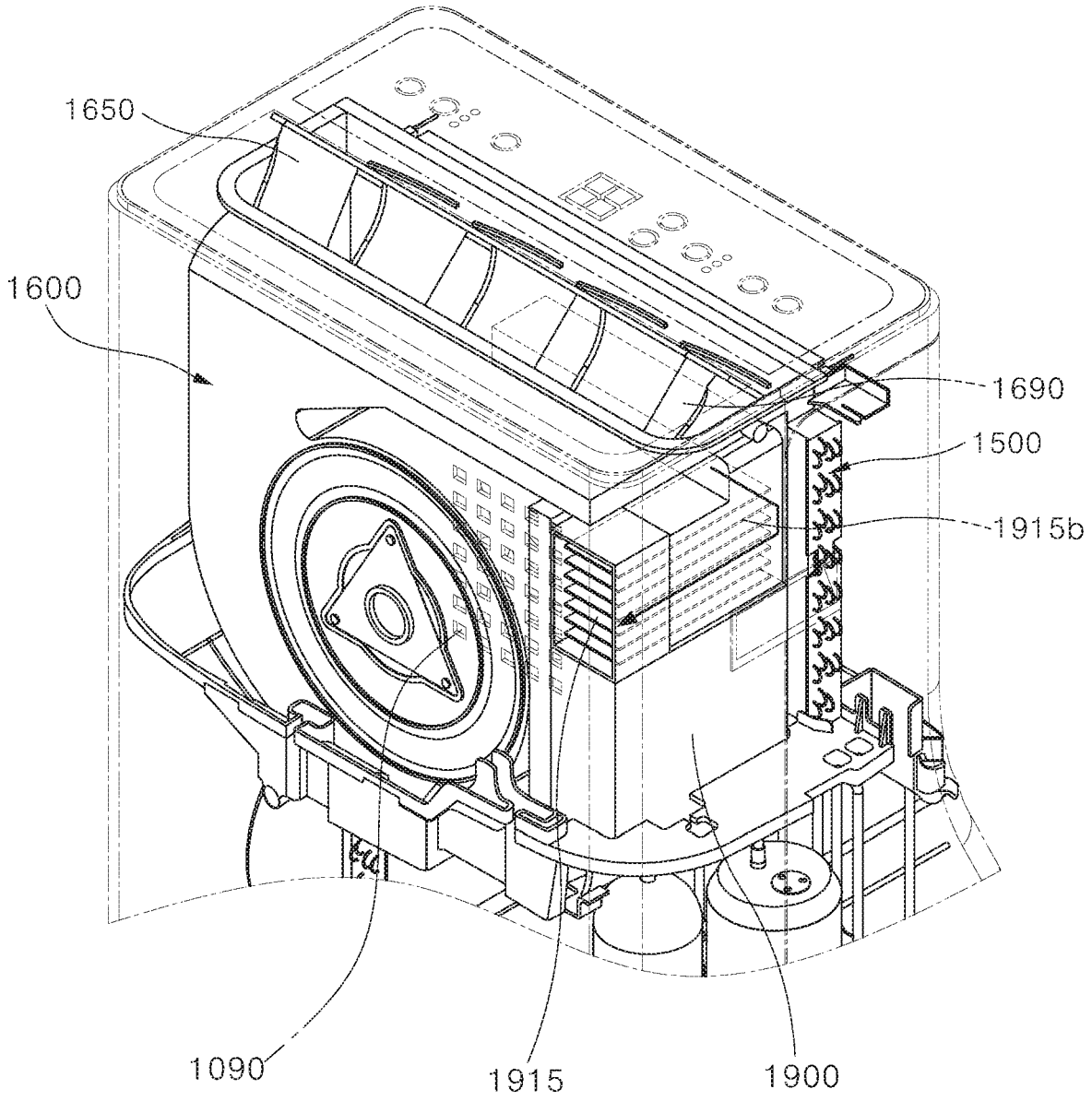
FIG. 17 is a view illustrating a cooling structure of a heat sink of the control box according to another embodiment of the present disclosure.
Figure 18:
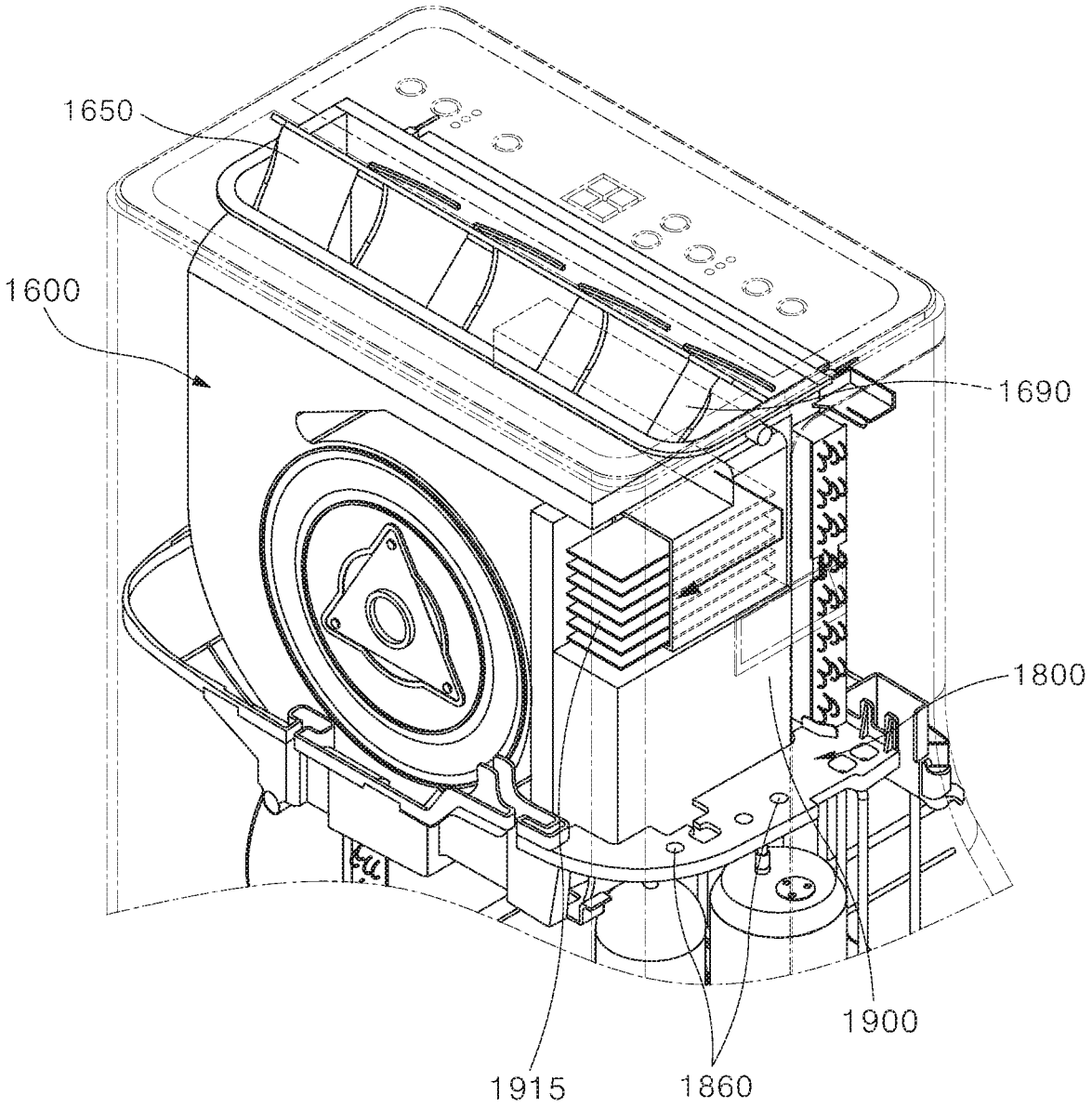
FIG. 18 is a view illustrating a cooling structure of a heat sink of a control box according to still another embodiment of the present disclosure.
Figure 19:
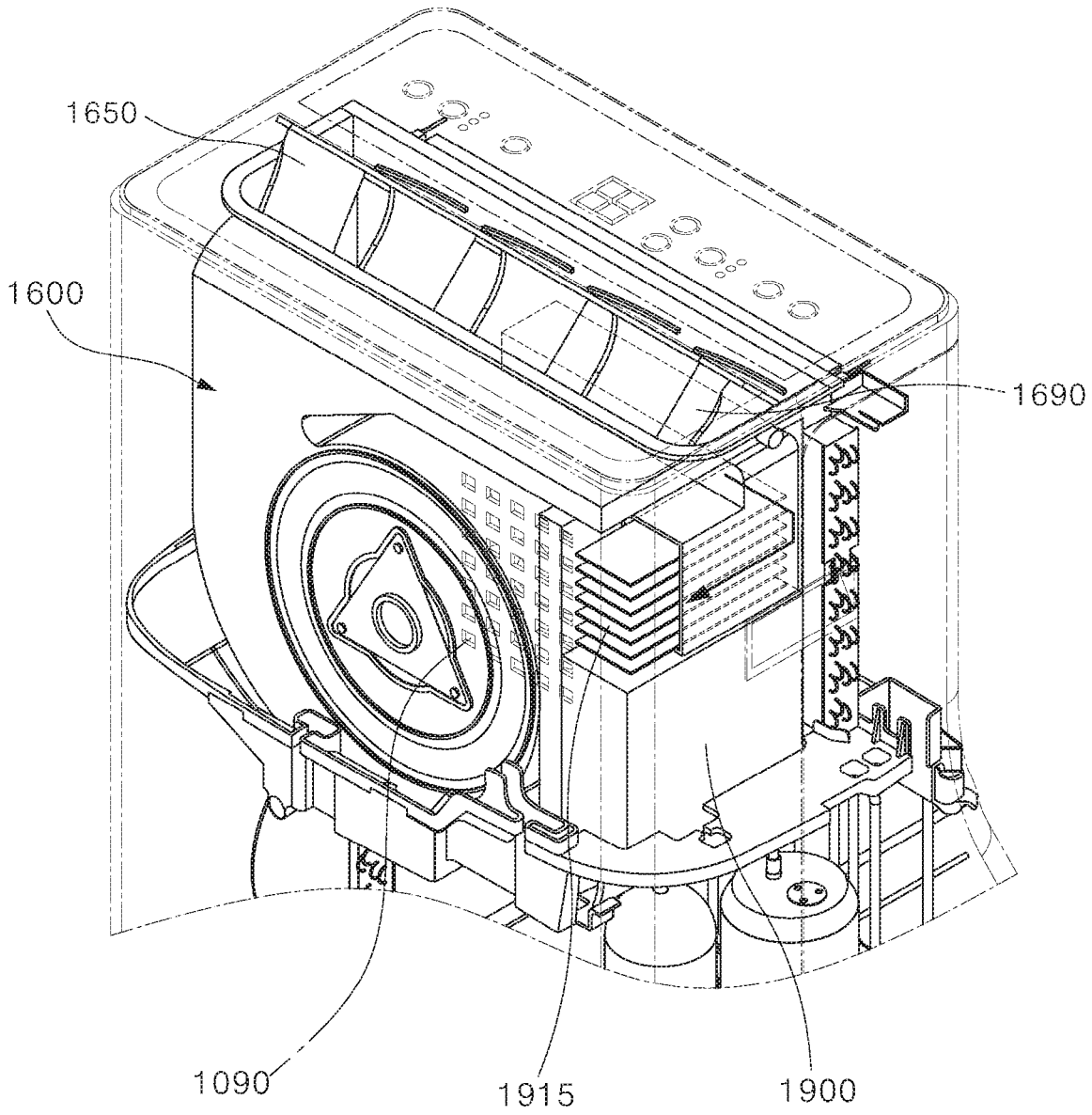
FIG. 19 is a view illustrating a cooling structure of a heat sink of a control box according to yet another embodiment of the present disclosure.

FIG. 16 is a view illustrating a coupling structure of the control box and a drain pan according to another embodiment of the present disclosure, FIG. 17 is a view illustrating a cooling structure of the heat sink of the control box according to another embodiment of the present disclosure, FIG. 18 is a view illustrating a cooling structure of a heat sink of a control box according to still another embodiment of the present disclosure, and FIG. 19 is a view illustrating a cooling structure of a heat sink of a control box according to yet another embodiment of the present disclosure.

Referring to FIG. 16, in a movable air conditioner according to the present embodiment, a heat sink 1915 is disposed on an upper portion of a control box 1900. The movable air conditioner according to the present embodiment has a structure in which cooled air is discharged upward and provides a structure configured to cool the heat sink 1915 by branching the cooled air and guiding the cooled air to the heat sink 1915.

Since the movable air conditioner has the structure in which the cooled air is discharged upward, a length of an auxiliary cooling flow path 1690 in FIG. 17 configured to guide the cooled air may be reduced by disposing the heat sink 1915 on the upper portion side of the control box 1900.

Referring to FIG. 17, the movable air conditioner according to the present disclosure includes the auxiliary cooling flow path 1690 so that the cooled air is supplied to the heat sink 1915 of the control box 1900. The auxiliary cooling flow path 1690 is formed in a second blowing unit 1600 disposed in a first accommodation space. The second blowing unit 1600 generates a flow to allow the air to be blown through the indoor heat exchanger 1500 which is an evaporator.

The auxiliary cooling flow path 1690 formed in the second blowing unit 1600 is a flow path branched from a discharge part through which the air is discharged toward an indoor side and serves to allow the cooled air to be supplied to the heat sink 1915 which is a part of the control box 1900 to be cooled.

In the case of the embodiment described in FIG. 17, the auxiliary cooling flow path 1690 is formed to extend to an inner surface of a case through the heat sink 1915, and an auxiliary discharge port 1090 is formed in the case corresponding to an inner region of the auxiliary cooling flow path 1690.

The auxiliary cooling flow path 1690 may be integrally formed with the second blowing unit 1600. The auxiliary cooling flow path 1690 is a flow pass configured to guide the cooled air passing through the evaporator to pass through the heat sink 1915. The auxiliary cooling flow path 1690 may be integrally formed with a housing of the second blowing unit 1600. Another embodiment may include a part in which the auxiliary cooling flow path 1690 is integrally formed with the second blowing unit 1600 and a part in which the auxiliary cooling flow path 1690 is integrally formed in the front housing 1100*a* in FIG. 4.

In other words, the auxiliary cooling flow path 1690 may be formed by coupling a portion of the second blowing unit 1600 and a portion of the front housing 1100*a* to each other.

Such an embodiment allows the cooled air to be discharged to the outside through the heat sink 1915, thereby stably discharging the heat generated from heat generating devices to the outside through the heat sink 1915. Further, the air which has cooled the heat sink 1915 is discharged again into an indoor space, thereby reducing flow resistance against the air passing through the auxiliary cooling flow path 1690.

Here, radiation fins 1915*b* provided in the heat sink 1915 may be disposed to have surfaces parallel to a flow direction of a fluid in the auxiliary cooling flow path 1690.

In the case of the embodiment described in FIG. 18, an auxiliary cooling flow path 1690 is formed to surround only a portion of a heat sink 1915 provided in a control box 1900 and configured such that air discharged from the auxiliary cooling flow path 1690 is diffused in a case without being discharged to an indoor side.

Such a structure allows cooled air to diffuse around the control box 1900, which has less of a cooling effect than the embodiment of FIG. 18, but has relatively low consumption of the cooled air. This is because discharge resistance of the cooled air is great, and thus an introduction flow rate of the cooled air may be relatively smaller than that in the previous embodiment.

In the case of the embodiment of FIG. 17, a drain pan 1800 may be provided with a communication hole 1860 so that the cooled air discharged from the auxiliary cooling flow path 1690 may be diffused into a first accommodation space in a lower portion of the movable air conditioner.

The air discharged to the communication hole 1860 provided in the drain pan 1800 is mixed with an outside air of a second accommodation space and is discharged after passing through an evaporator. Such a structure has an effect of improving a cooling effect of the evaporator.

In the case of the embodiment described in FIG. 19, an auxiliary cooling flow path 1690 is formed to surround only a portion of a heat sink 1915 as in the embodiment of FIG. 18, and an auxiliary discharge port 1090, through which the air that has cooled a heat sink 1915 may be discharged to the outside of a housing, is provided.

Figure 20:
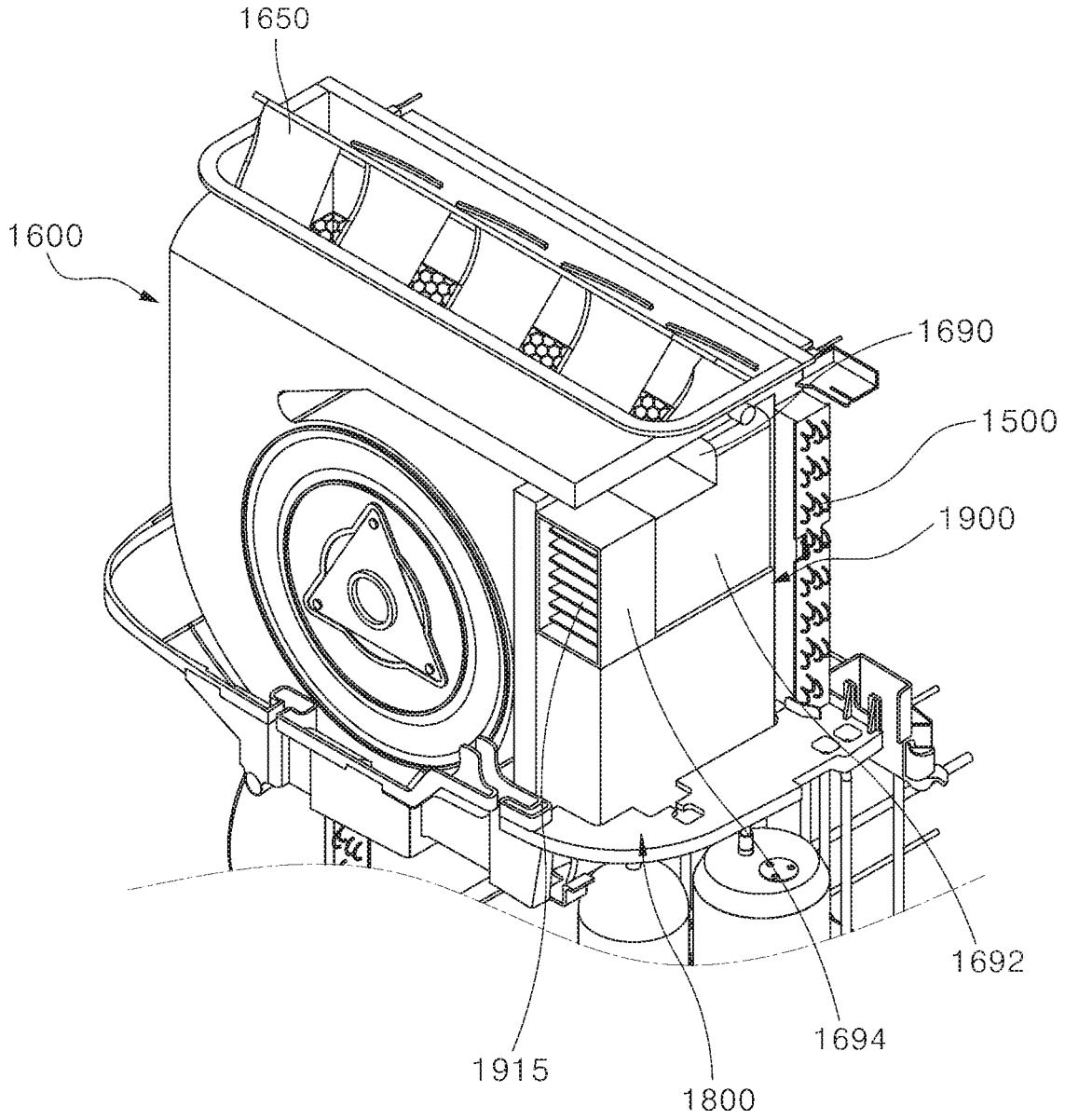
FIG. 20 is a perspective view illustrating a state in which the control box is installed on the drain pan according to another embodiment of the present disclosure.

FIG. 20 is a perspective view illustrating a state in which the control box is installed on the drain pan according to another embodiment of the present disclosure.

As illustrated in the drawing, the drain pan 1800 has an approximately quadrangular shape corresponding to the formation of a cross section of the accommodation space, and partitions the accommodation space, which is formed between a front housing 1100*a* and a rear housing 1100*b*, into upper and lower portions.

FIG. 20 illustrates the auxiliary cooling flow path 1690 which is formed by coupling a portion 1692 of the second blowing unit 1600 and a portion 1694 of the front housing to each other.

Although the present disclosure has been described with reference to the exemplified drawings, it is to be understood that the disclosure is not limited to the embodiments and drawings disclosed in this specification, and those skilled in the art will appreciate that various modifications are possible without departing from the scope and spirit of the disclosure. In addition, Although the function and effect according to the constitution of the present disclosure are not explicitly described while describing the embodiments of the present disclosure, it should be appreciated that predictable effects are also to be recognized by the configuration.

What is claimed is:

1. A movable air conditioner comprising:

a casing configured to form an exterior;

a drain pan configured to partition an accommodation space provided in the casing into a lower accommodation space and an upper accommodation space;

a refrigerant circuit part including an outdoor heat exchange part disposed in the lower accommodation space, an indoor heat exchange part disposed in the upper accommodation space, and a compressor; and a control box configured to control the refrigerant circuit part, wherein the control box includes a heat sink configured to cool a heat generating device of the control box, the control box being coupled to the drain pan such that the heat sink is accommodated in the drain pan, and the drain pan includes a first opening configured to expose the heat sink to the upper accommodation space.

2. The movable air conditioner of claim 1, wherein the control box includes:

a printed circuit board on which devices including the heat generating device are mounted, a frame coupled to and surrounding an edge of the printed circuit board, a first casing coupled to the frame and exposing the heat sink attached to the heat generating device, and a second casing coupled to the frame and surrounding the printed circuit board on a side of the control box opposite to the first casing.

3. The movable air conditioner of claim 2, wherein at least one of the first casing or the second casing includes a coupling groove coupled to an insertion protrusion formed on the drain pan.

4. The movable air conditioner of claim 2, wherein the frame includes a first rib configured to partition an upper surface of the heat sink and a portion configured to surround an upper surface of the printed circuit board.

5. The movable air conditioner of claim 4, wherein the frame includes a cable guide having a shape connecting the first rib to a lower end of the frame.

6. The movable air conditioner of claim 5, wherein the cable guide has one of a L-shaped or C-shaped cross section.

7. The movable air conditioner of claim 1, wherein the drain pan includes a second opening configured to expose the heat sink so that air introduced through the first opening flows through the second opening into a lower space of the drain pan.

8. A movable air conditioner comprising:

a casing configured to form an exterior of the air conditioner;

a drain pan configured to partition an accommodation space provided in the casing into a lower accommodation space and an upper accommodation space;

a refrigerant circuit part including an outdoor heat exchange part disposed in the lower accommodation space, an indoor heat exchange part disposed in the upper accommodation space, and a compressor; and a control box configured to control the refrigerant circuit part, wherein the control box includes a heat sink and a heat generating device, the heat sink being configured to cool the heat generating device of the control box and being accommodated in the drain pan.

9. The movable air conditioner of claim 8, wherein air in an upper region of the drain pan and air in a lower region of the drain pan communicate with each other through an opening in the drain pan, and the heat sink is configured to extend into the opening in the drain pan between the upper region and the lower region.

10. The movable air conditioner of claim 8, wherein a portion of the heat sink is in contact with air inside the upper accommodation space, and another portion of the heat sink is in contact with air inside the lower accommodation space.

11. The movable air conditioner of claim 8, wherein the housing includes a lower air suction port communicating with the outdoor heat exchange part and an upper air suction port communicating with the indoor heat exchange part, and the upper air suction port includes a main suction port through which air suctioned into the indoor heat exchange part is introduced and an auxiliary suction port through which air suctioned into the heat sink is introduced.

12. The movable air conditioner of claim 11, wherein the auxiliary suction port includes a vane configured to guide the air passing therethrough to the heat sink.

13. The movable air conditioner of claim 11, wherein the auxiliary suction port and the main suction port are covered by a single upper suction port filter.

14. A movable air conditioner comprising:

a housing configured to form an exterior of the air conditioner;

a drain pan configured to vertically partition an accommodation space provided in the housing into a first accommodation space on a lower portion thereof and a second accommodation space on an upper portion thereof;

an outdoor heat exchanger installed in the first accommodation space;

a first blowing unit installed adjacent to the outdoor heat exchanger in the first accommodation space;

an indoor heat exchanger installed in the second accommodation space;

a second blowing unit installed adjacent to the indoor heat exchanger in the second accommodation space;

a control box mounted on the drain pan;

a heat sink provided in the control box; and an auxiliary cooling flow path connected to the second blowing unit and configured to guide air cooled while passing through the indoor heat exchanger to the heat sink.

15. The movable air conditioner of claim 14, wherein the auxiliary cooling flow path surrounds at least a portion of the heat sink and extends to an inner surface of the housing, and the housing includes an auxiliary discharge port configured to discharge the air supplied to the auxiliary cooling flow path to the outside of the housing.

16. The movable air conditioner of claim 14, wherein the auxiliary cooling flow path surrounds only a portion of the heat sink.

17. The movable air conditioner of claim 16, wherein the housing includes an auxiliary discharge port configured to discharge the air supplied to the auxiliary cooling flow path to the outside of the housing.

18. The movable air conditioner of claim 16, wherein the heat sink includes a plurality of radiation fins, and the radiation fins are arranged such that surfaces thereof are parallel to a flow surface of the auxiliary cooling flow path.

19. The movable air conditioner of claim 14, wherein the drain pan includes a communication hole configured to allow the air discharged from the auxiliary cooling flow path to be introduced into the first accommodation space.

20. A movable air conditioner comprising:

a housing configured to form an exterior of the air conditioner;

a drain pan configured to vertically partition an accommodation space provided in the housing into a first accommodation space on a lower portion thereof and a second accommodation space on an upper portion thereof;

an outdoor heat exchanger installed in the first accommodation space;

a first blowing unit installed adjacent to the outdoor heat exchanger in the first accommodation space;

an indoor heat exchanger installed in the second accommodation space;

a second blowing unit installed adjacent to the indoor heat exchanger in the second accommodation space;

a control box installed in the second accommodation space;

a heat sink provided in the control box; and an auxiliary cooling flow path in flow communication with a discharge flow path of the second blowing unit and configured to guide air cooled while passing through the indoor heat exchanger to the heat sink.

21. The movable air conditioner of claim 20, wherein the auxiliary cooling flow path is integrally formed with the discharge flow path of the second blowing unit.

22. The movable air conditioner of claim 20, wherein the auxiliary cooling flow path includes a portion integrally formed with the second blowing unit and a portion integrally formed with the housing.

* * * * *